US006099116A

United States Patent [19]

Fujita et al.

[11] Patent Number: 6,099,116

[45] Date of Patent: Aug. 8, 2000

[54] INK-JET PRINTING APPARATUS FOR PERFORMING PRINTING WITH INK AND PRINTING ABILITY IMPROVING LIQUID

[75] Inventors: Miyuki Fujita, Tokyo; Minako Kato, Yokohama, both of Japan

[73] Assignee: Canon Kabushiki Kaisha, Tokyo, Japan

[21] Appl. No.: 08/975,069

[22] Filed: Nov. 20, 1997

[30] Foreign Application Priority Data

Nov. 22, 1996 [JP] Japan ..... 8-311989

[51] Int. Cl.[7] ..... B41J 2/01

[52] U.S. Cl. ..... 347/101; 347/103; 347/107

[58] Field of Search ..... 347/101, 103, 347/5, 6, 20, 21, 40, 47, 56, 61, 107

[56] References Cited

U.S. PATENT DOCUMENTS

| | | | |
|---|---|---|---|
| 4,313,124 | 1/1982 | Hara . | |
| 4,345,262 | 8/1982 | Shirato et al. . | |
| 4,459,600 | 7/1984 | Sato et al. . | |
| 4,463,359 | 7/1984 | Ayata et al. . | |
| 4,538,160 | 8/1985 | Uchiyama | 347/101 |
| 4,558,333 | 12/1985 | Sugitani et al. . | |
| 4,608,577 | 8/1986 | Hori . | |
| 4,723,129 | 2/1988 | Endo et al. . | |
| 4,740,796 | 4/1988 | Endo et al. . | |

FOREIGN PATENT DOCUMENTS

| | | |
|---|---|---|
| 0 726 157 | 8/1996 | European Pat. Off. . |
| 0 791 470 | 8/1997 | European Pat. Off. . |
| 54-56847 | 5/1979 | Japan . |
| 58-128862 | 8/1983 | Japan . |
| 59-123670 | 7/1984 | Japan . |
| 59-138461 | 8/1984 | Japan . |
| 60-71260 | 4/1985 | Japan . |
| 1-63185 | 3/1989 | Japan . |
| 5-202328 | 8/1993 | Japan . |
| 5-330083 | 12/1993 | Japan . |
| 8-52867 | 2/1996 | Japan . |
| 8-104000 | 4/1996 | Japan . |
| 9-109381 | 4/1997 | Japan . |
| 9-226154 | 9/1997 | Japan . |
| 9-262982 | 10/1997 | Japan . |
| 0 726 158 | 8/1996 | WIPO . |

*Primary Examiner*—William Royer
*Assistant Examiner*—Hoan Tran
*Attorney, Agent, or Firm*—Fitzpatrick, Cella, Harper & Scinto

[57] ABSTRACT

When printing is performed by ejecting respective inks of black and cyan and a processing liquid, an OR data and an AND data are derived from an extracted data for the processing liquid derived from an ejection data of the black ink and an extracted data for the processing liquid derived from an ejection data for the cyan ink. An OR data of the OR data derived from the extracted data and data derived by shifting the AND data for one pixel, is taken as an ejection data for the processing liquid. By this, for the pixel, on which black and cyan are ejected in overlapping manner as represented by the AND data, the processing liquid is further ejected on a pixel adjacent thereto. Thus, the processing liquid in an amount corresponding to an ink ejection amount can be ejected to provide sufficient water-resistance.

15 Claims, 15 Drawing Sheets

INK-JET PRINTING APPARATUS FOR PERFORMING PRINTING WITH INK AND PRINTING ABILITY IMPROVING LIQUID

This application is based on application Ser. No. 311, 989/1996 filed Nov. 22, 1996 in Japan, the content of which is incorporated hereinto by reference.

BACKGROUND OF THE INVENTION

1. Field of the Invention

The present invention relates to an ink-jet printing apparatus and an ink-jet printing method. More specifically, the invention relates to an ink-jet printing apparatus and an ink-jet printing method performing printing by ejecting an ink and a printing ability improving liquid which reacts with the ink to make the ink insoluble or coagulated.

2. Description of the Related Art

Associating with the spread of copy machines, information processing devices, such as word processor, computers and the like, and communication devices, printing apparatus performing digital image printing employing a head of an ink-jet system as one of image forming (printing) apparatus for these devices, are also spreading. In such printing apparatus, it is typical to employ a head having a plurality of ink ejection openings and liquid passages in high density, as a print head that integrates a plurality of printing elements in a high density array, for improving printing speed and to employ a plurality of such heads adapting to color printing.

FIG. 1 shows an example of construction of a printing portion employing the foregoing head for performing printing on a printing paper. In FIG. 1, reference numerals 701 denote ink cartridges, in which color inks of four colors of black, cyan, magenta and yellow are stored. To the ink cartridges 701 of respective colors, ink-jet heads 702 respectively corresponding to the ink cartridges are connected. The ink-jet heads 702 are mounted on a carriage 706 together with the ink cartridges 701.

A plurality of ink ejection openings arranged on the ink-jet head 702 as viewed from ink ejecting direction is illustrated in FIG. 2. In FIG. 2, the reference numeral 801 denotes the ink ejection opening. The ink ejection openings 801 are aligned in parallel to a Y-axis. The arrangement direction of the ejection opening may be slightly angled on XY plane in the drawing. In this case, while the head 702 is scanned in the traveling direction X, ejection may be performed from respective ejection openings with shifted timing. While the example shown in FIG. 1 arranges all of heads for four colors in scanning direction, the arrangement of the heads is not limited to the shown one. For instance, the four heads may be aligned in Y direction as paper feeding direction. Also, it is possible to arrange only one or two heads for one or two colors in the paper feeding direction.

Returning to FIG. 1, the reference numeral 703 denotes a paper feed roller rotating together with an auxiliary roller 704 in directions shown by arrows for feeding a printing paper 707 in the y direction at a predetermined timing. The reference numerals 705 denotes a pair of paper supply rollers performing supply of the printing paper, and in conjunction therewith, serving to flatten the printing surface of the printing paper 707 by applying a tension force on the printing paper 707 by a difference of rotation speed from that of the rollers 703 and 704. As set forth above, a carriage 706 mounts four ink-jet heads 702 and ink cartridges 701 and can move to perform scanning of the heads during printing operation. In conjunction therewith, at a non-printing state or upon performing an ejection recovery operation or the like for the head, the carriage 706 may be moved into a home position h as illustrated by broken line in FIG. 1. It should be noted that a structure of a cap or the like for performing the ejection recovery operation may be per se known in the art, and thus is not illustrated for simplification of illustration and disclosure.

The carriage 706 is located at the home position before initiation of printing and is responsive to a print start command to move in x direction in the drawing. During moving of the carriage in the x direction, ink ejection is performed through the ejection openings 801 of the head 702 depending upon printing data for performing printing over a width D (see FIG. 2) on the printing surface. Once printing for one scanning cycle is completed, at which the carriage 706 reaches end of the printing paper, the carriage 706 is returned to the home position for repeating similar scanning cycles. Bi-directional printing may be performed instead of uni-directional printing described above. During an interval between each scanning cycle, the paper feed roller 703 is driven to rotate for feeding a paper an amount corresponding to the width D. Thus, per each scanning cycle of the carriage, printing for the width D of the ejection opening array of the head and paper feeding are alternately repeated to complete printing for one page.

In ink-jet printing apparatus as set forth above, there is a progressively increasing demand for forming a color image on a plane paper, in the recent years. Even in this case, comparable image quality as that printed on a dedicated printing medium has been substantially achieved. However, when a water-base ink is employed, water-resistance of the image is insufficient so that storing ability is low.

As a measure for the problem set forth above, Japanese Patent Application Laid-Open No. 58-128862 (1983) discloses a technology to overlay the ink and a processing liquid effective for fixing the ink by ejecting the processing liquid before or after formation of the image of dots by ejection of the ink. Also, Japanese Patent Application Laid-Open No. 64-63185 (1989) discloses a technology for forming a dot by ejecting the ink after deposition of a compound which makes a dye in the ink insoluble. Furthermore, Japanese Patent Application Laid-Open No. 5-202328 (1993) discloses a method of depositing a processing liquid for fixing the ink providing water-resistance, by ejecting on the printing medium by ink-jet system, in advance of a dot forming operation, a method of depositing the processing liquid on the printing medium by roller application, and a method of improving fixing ability and water-resistance of the ink by mixing the ink and the processing liquid during flying as ejected from an ejector and depositing on the printing medium. Also, in order to avoiding excessive consumption of the processing liquid, commonly owned Japanese Patent Application Laid-Open No. 8-52867 (1996) discloses a technology for printing the processing liquid for improving fixing ability and water-resistance of the ink at a predetermined ratio relative to each pixel. Further, in Japanese Patent Application Laid-open No. 9-226154 (1997), attention is paid particularly to an edge portion of the image. In a region other than the edge portion of the image, the processing liquid is ejected at a predetermined ratio, whereas, on the edge portion of the image, the processing liquid is ejected to avoid consumption of an extra amount of the processing liquid to certainly provide water-resistance. Furthermore, commonly owned Japanese Patent Application Laid-open No. 8-104000 (1996) discloses a method for controlling the kind of an appropriate processing liquid and the ejection amount depending upon the peripheral environment of the printing apparatus and kind of the printing medium.

It should be noted that the foregoing processing liquid is effective not only for improving water-resistance of the printed image but also for enhancing density, preventing bleeding and feathering, and the like. In view of these effects, the processing liquid may also be referred to as a printing ability improving liquid.

However, in any of the prior arts set forth above, a manner, an amount and so on of ejection of the processing liquid were handled similarly either in the case where one ink droplet is ejected for one pixel or in the case where the two or more droplets are ejected for one pixel. Therefore, under certain circumstance, water-resistance in the mixed color portion may become insufficient. This problem will be more specifically explained hereinafter.

FIGS. 3A to 3D show four patterns of a head construction including a processing liquid ejection head and of deposition of the ink droplet and the processing liquid on the printing medium. FIG. 3A shows a construction, in which respective heads 702Bk, 702C, 702M and 702Y for black (Bk), cyan (C), magenta (M) and yellow (Y) and a head 702S for the processing liquid (S) are arranged in a scanning direction. FIG. 3B shows a construction, in which a head 702col in which ejection openings for cyan, magenta and yellow are arranged in the paper feeding direction, the black head 702Bk and the processing liquid head 702S are arranged. FIG. 3C shows a construction, in which the heads for respective colors are arranged in similar manner to that of FIG. 3A but dedicated processing liquid heads 702S, 702Sm, 702Sc and 702Sk are arranged adjacent to respective of corresponding color heads. FIG. 3D shows a construction, in which a head 702INK having ejection openings for Y, M, C and Bk are aligned in paper feeding direction and the processing liquid head 702S are arranged in the scanning direction.

When these four kinds of head constructions are employed, there are various deposition states of the ink droplet and the processing liquid droplet, namely various manner of printing methods, depending upon construction of respective head array and manner or the like of generating the processing liquid ejection data. Respective examples are shown on the right sides of respective of FIGS. 3A to 3D. These figures illustrate examples of forming a green (C+Y) image.

FIGS. 3A and 3C show depositing condition formed by scanning at once. On the other hand, FIGS. 3B and 3D show deposition condition formed by two scanning times between which paper feeding operation is inserted.

Further, as a manner of generation of the processing liquid ejection data, deposition conditions shown in FIGS. 3A and 3B are cases where the processing liquid ejection data is generated by deriving a logical sum of ejection data of Y and C. On the other hand, deposition conditions shown in FIGS. 3C and 3D are the case where the processing liquid ejection data is generated corresponding to respective ejection data of Y and C.

The amount of the processing liquid necessary for making the ink insoluble or coagulated is differentiated depending upon composition of respective color inks, ejection amount, number of ink droplets to be ejected for one pixel and the like. Accordingly, it is not always required to eject one processing liquid droplet for one ink droplet.

On the other hand, among ejection data generation methods shown in FIGS. 3A to 3D, the methods shown in FIGS. 3A and 3B are the ones for generating the processing liquid ejection data by logical sum of respective colors of ejection data, only one processing liquid droplet is ejected even when a plurality of ink droplets are ejected for one pixel. Therefore, sufficient processing liquid as required may be not ejected with respect to the ink. Accordingly, in the case of printing by a primary color, while water-resistance or the like is sufficient, water-resistance or the like can be insufficient for the case of printing of secondary color or more, in which a plurality of colors of inks are overlaid.

SUMMARY OF THE INVENTION

It is an object of the present invention to provide an ink-jet printing apparatus and an ink-jet printing method which can eject a processing liquid corresponding to an ejected ink amount and whereby can obtain improvement of printing ability such as sufficient water-resistance and the like.

Another object of the present invention is to provide an ink-jet printing apparatus and an ink-jet printing method which can be adapted for the case where the ink amount to be treated by the printing ability improving liquid is relatively large, by performing ejection of the printing ability improving liquid on a basis of OR data of data and, in conjunction therewith, performing ejection of the printing ability improving liquid on a basis of AND data of the data, the data being extracted from ejection data of a plurality kinds of inks under a predetermined rule, the AND data of the data and the OR data of the data being as ejection data of the printing ability improving liquid, ejection based on the AND data is performed at different timing of ejection based on the OR data for overlapping printing with the plurality kinds of inks.

In a first aspect of the present invention, there is an ink-jet printing apparatus performing printing by ejecting an ink and a printing ability improving liquid onto a printing medium with employing a plurality of ink ejecting portions for ejecting the ink and an ejecting portion for ejecting the printing ability improving liquid for making the ink insoluble or coagulated, said apparatus comprising:

signal supply means for supplying a signal by which the ink or the printing ability improving liquid is ejected from the plurality of ink ejecting portions;

wherein said signal supply means supplies the signal so that ejection timings of the printing ability improving liquid on a basis of respective of OR data and AND data of respective extracted data, which are respectively extracted from respective ejection data for the plurality of ink ejecting portions in accordance with respective predetermined rules, are differentiated.

In a second aspect of the present invention, there is an ink-jet printing method performing printing by ejecting an ink and a printing ability improving liquid onto a printing medium with employing a plurality of ink ejecting portions for ejecting the ink and an ejecting portion for ejecting the printing ability enhancing liquid for making the ink insoluble or coagulated, said method comprising the step of:

supplying a signal by which the ink or the printing ability improving liquid is ejected from the plurality of ink ejecting portions wherein said step for supplying the signal supplies the signal so that ejection timings of the printing ability improving liquid on a basis of respective of OR data and AND data of respective extracted data, which are respectively extracted from respective ejection data for the plurality of ink ejecting portions in accordance with respective predetermined rules, are differentiated.

In a third aspect of the present invention, there is a method of generating an ejection data for an ink-jet printing apparatus performing printing by ejecting an ink and a printing ability improving liquid onto a printing medium with employing a plurality of ink ejecting portions for ejecting the ink and an ejecting portion for ejecting the printing ability improving liquid for making the ink insoluble or coagulated, said method comprising the steps of:

generating OR data and AND data of respective extracted data which are respectively extracted from respective ejection data for the plurality of ink ejecting portions in accordance with respective predetermined rules; and deriving an ejection data of the printing ability improving liquid on a basis of respective of the OR data and the AND data generated.

The above and other objects effects features and advantages of the present invention will become more apparent from the following description of embodiments thereof taken in conjunction with the accompanying drawings.

DESCRIPTION OF THE PREFERRED EMBODIMENT

The preferred embodiments of the present invention will be described hereinafter in detail with reference to the drawings.

First Embodiment

Figure 1:
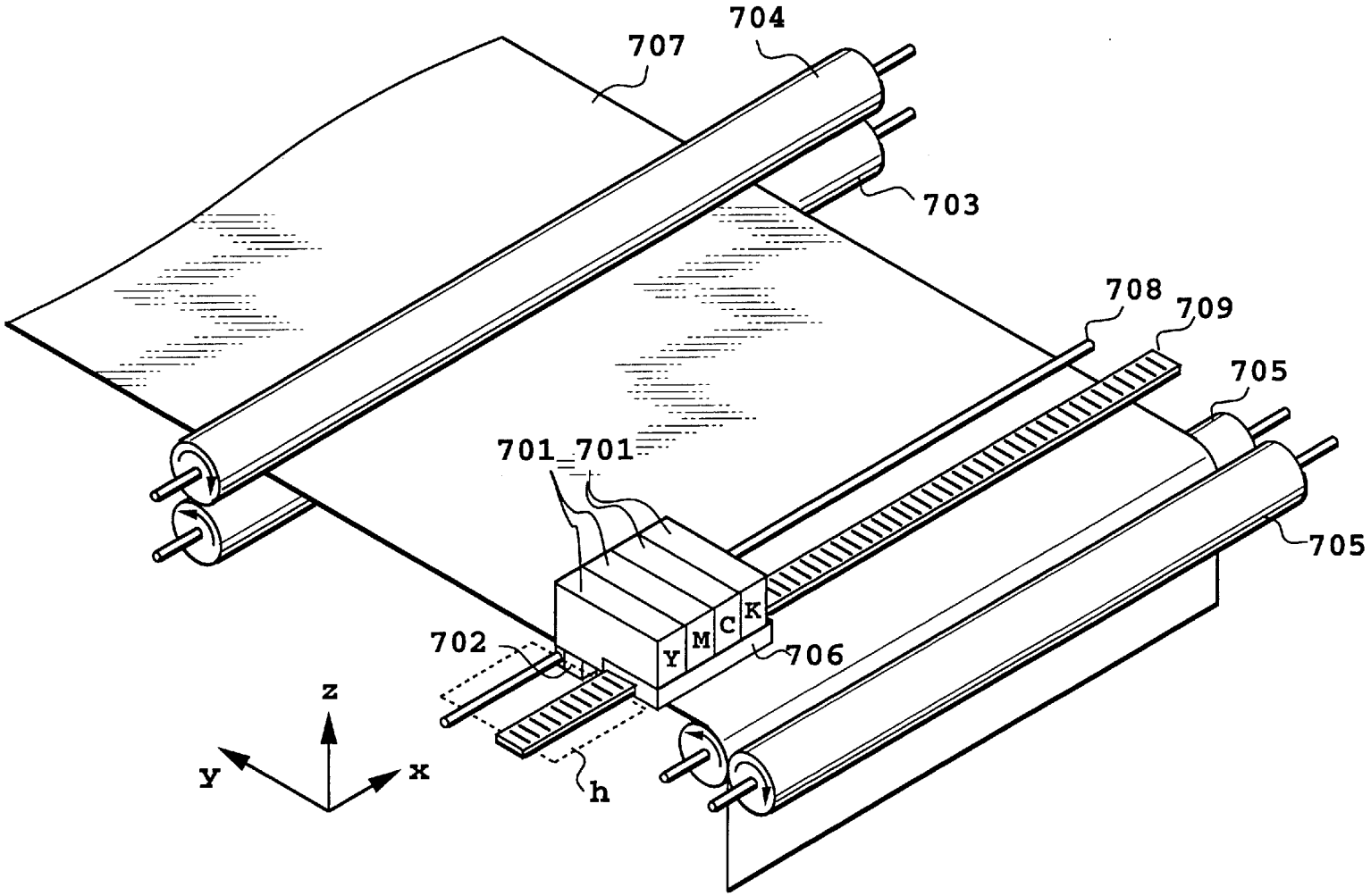
FIG. 1 is a general perspective view showing one example of a construction of an ink-jet printing apparatus.
Figure 2:
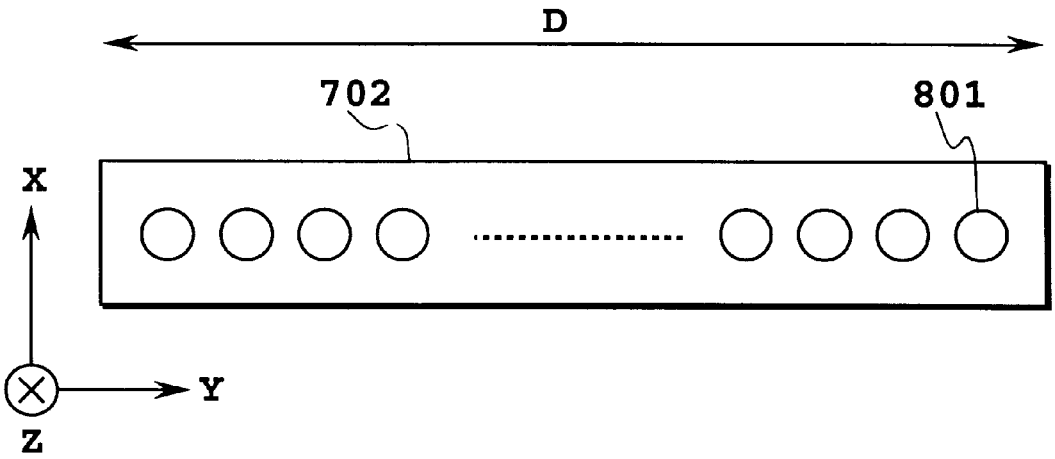
FIG. 2 is a diagrammatic illustration showing an ejection opening array of an ink-jet head to be employed in the ink-jet printing apparatus shown in FIG. 1.
Figure 3B:
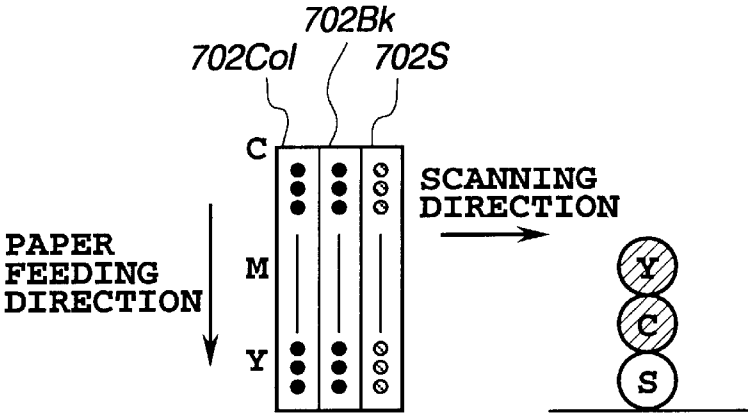
FIGS. 3A to 3D are illustration showing arrangements of heads ejecting respective colors of inks and processing liquids upon color printing and examples of deposition of ink droplets and processing liquid droplets in the head arrangement.

An ink-jet printing apparatus of the shown embodiment employs an ink-jet head having a construction shown in FIG. 3B in the apparatus shown in FIG. 1, and therefore, in the following disclosure, the detailed description will be neglected. The shown embodiment of the printing apparatus can perform printing in a dot density of 600 dpi. Ejection openings in each head shown in FIG. 3B is arranged in a pitch of 600 dpi (about 42 $\mu$m). In FIG. 3B, number of ejection openings of the color head 720col is 80 for respective colors, and number of ejection openings of the head 702Bk for black is triple (240) or more than that of each color in the color head 720col. In a printing mode in the shown embodiment, only 80 of ejection openings located at the corresponding positions to those of the ejection openings for cyan are used. Namely, a paper feeding amount to be performed within an interval between scanning cycles corresponds to 80 pixels. With printing the paper feeding into respective scannings, three scanning times, i.e. scanning for ejecting a black (Bk) ink and a cyan (C) ink, scanning for ejecting a magenta ink (M), and scanning for ejecting a yellow (Y) ink, are performed to complete an image in the scanning region.

Ejection amounts of respective of Y, M and C inks and a processing liquid are set at 15 pl per one droplet, and ejection amount of the black ink is set at 30 pl per one droplet. Such setting of the ejection amounts of respective inks and the processing liquid is selected for necessary enhancement of black ink in comparison with the Y, M, C inks. On the other hand, the processing liquid making the dye in the ink insoluble in the shown embodiment and subsequent embodiments, is required to be half in volume of that of the ink. Accordingly, one droplet of the processing liquid should be required for one droplet of the black ink. In contrast, one droplet of the processing liquid should be sufficient for two droplets of respective color inks of Y, M and C.

Of course, application of the present invention is not specified to the ink-jet head having a structure shown in FIG. 3B. As set forth above, the number of ink droplet of each color and the number of the processing liquid droplet is essentially determined on a basis of manner of generation of the ejection data of the processing liquid. More specifically, once generation of the ejection data is performed and the corresponding number of the ink droplets and the number of the processing liquid droplets are determined, printing with the determined number of ink droplets and number of the processing liquid droplets can be performed by appropriately determining the manner of scanning of the head and the manner of feeding the paper, employing the heads having any form of ejection opening array.

Figure 4:
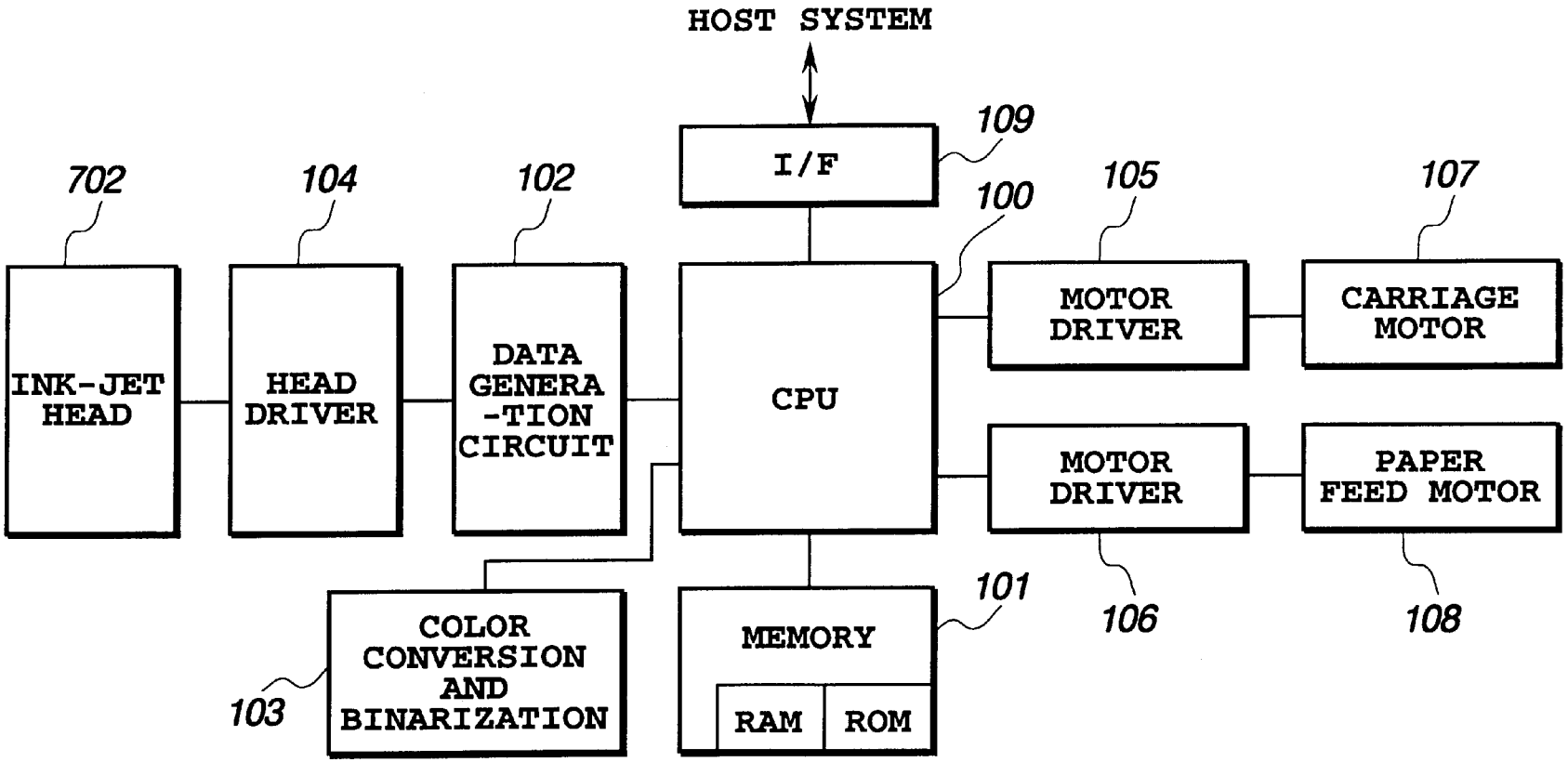
FIG. 4 is a block diagram showing a construction of a control system of one embodiment of an ink-jet printing apparatus according to the present invention.

FIG. 4 is a block diagram showing a construction of a control system of the shown embodiment of the ink-jet printing apparatus.

Figure 5:
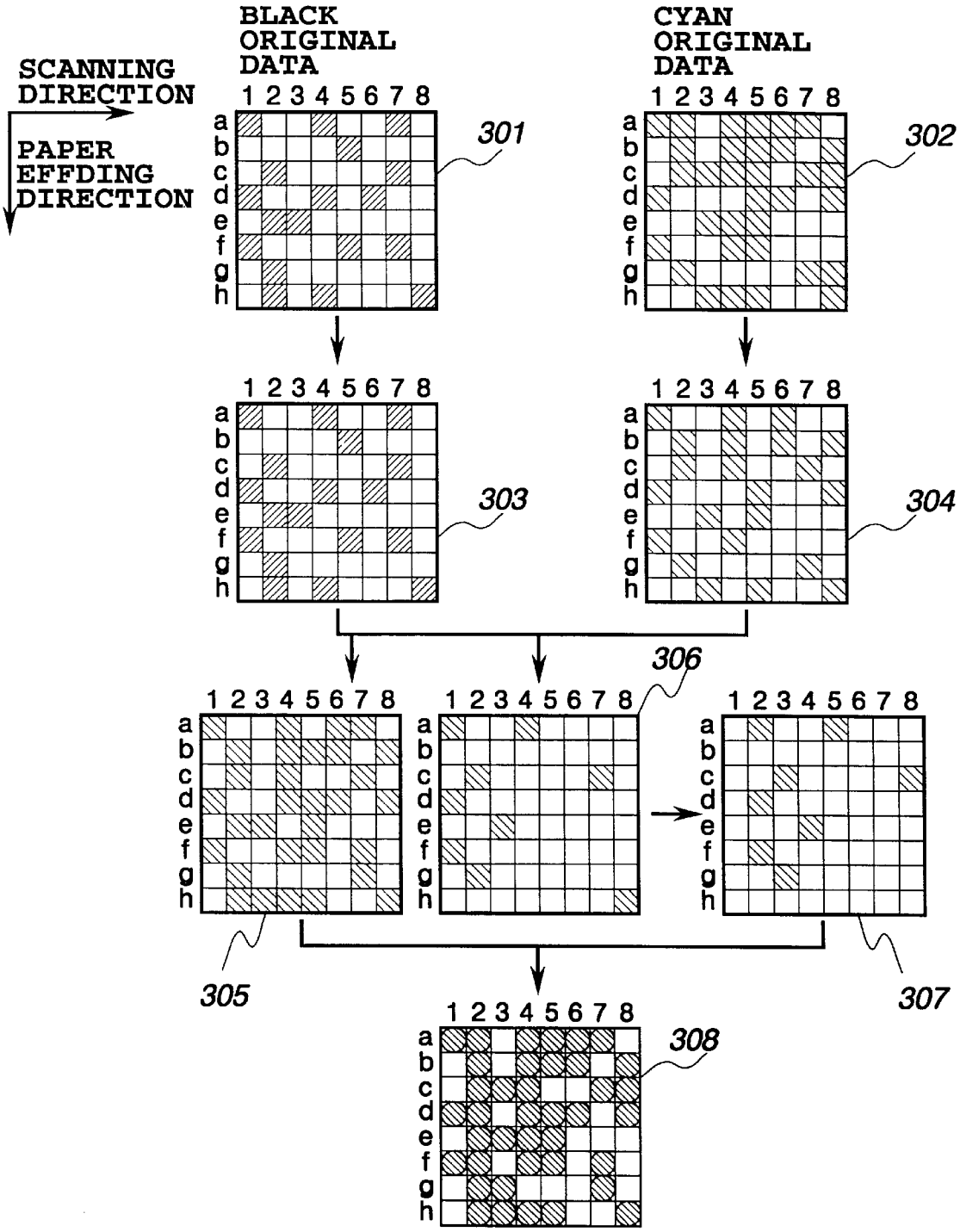
FIG. 5 is an illustration for explaining generation of a processing liquid data in a first embodiment of the present invention.

CPU 100 controls data processing and various operation in the shown embodiment of the printing apparatus, such as generation of ejection data which will be explained later, scanning of the ink-jet head 702 to be performed by moving the carriage 706, paper feeding and so on. More specifically, printing data for red (R), green (G) and blue (B) input from a host system via an interface (I/F) are converted into binary data of Y, M, C, Bk by a color conversion and binarizing circuit. By this, original data (ejection data) 301, 302 of black (Bk) and cyan (C) shown in FIG. 5 are generated. These data are temporarily stored in a predetermined buffer in a memory 101. Then, associating with printing operation, the processing liquid ejection data is generated on a basis of the stored data by means of a data generation circuit 102 and fed to a head driver 104 together with the ejection data of respective color inks to perform ejection of the inks and the processing liquid through the ink-jet heads 702.

Figure 6:
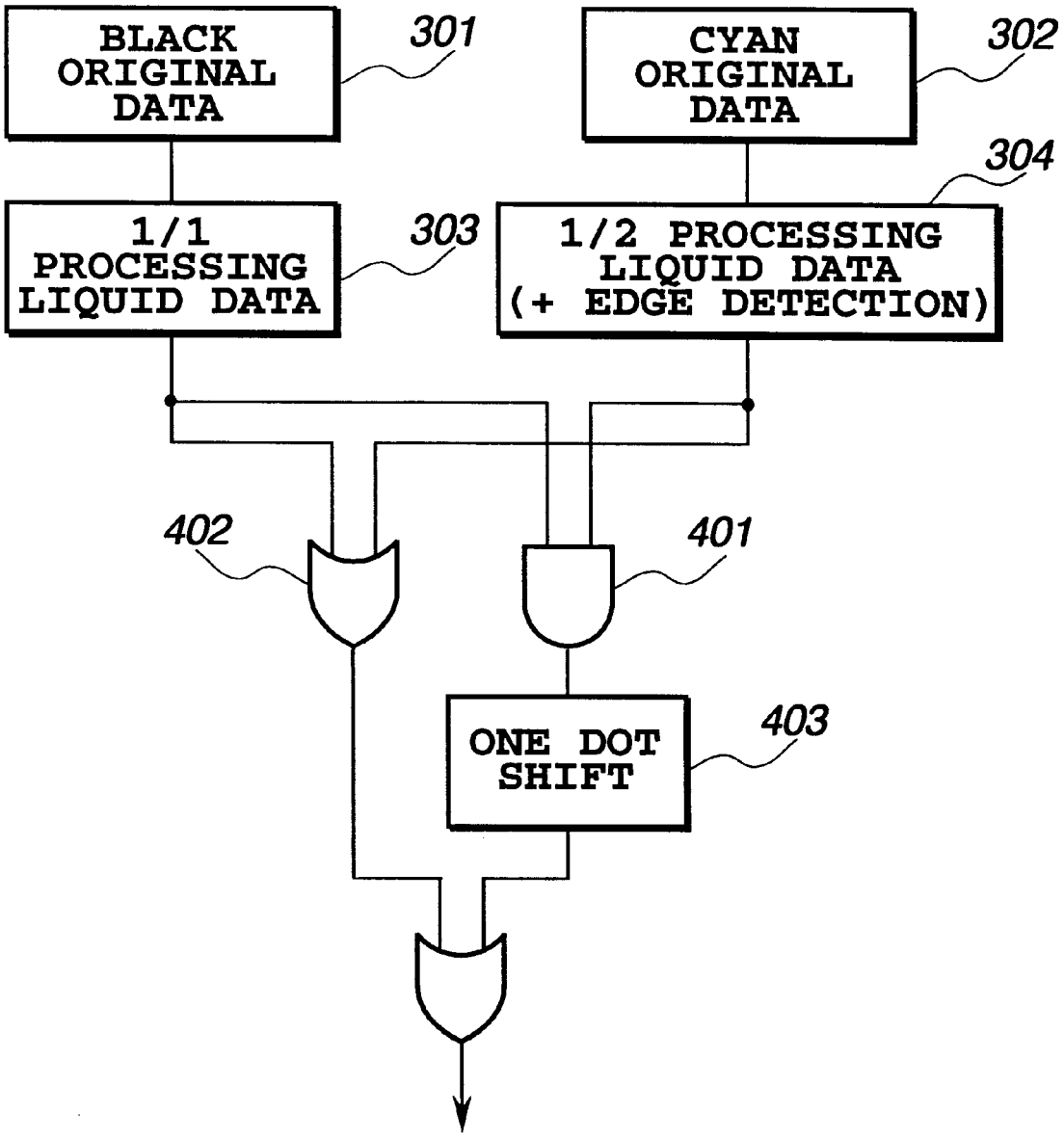
FIG. 6 is a block diagram of a construction for generating the processing liquid data shown in FIG. 5.

The data generation circuit 102 includes a construction shown in FIG. 6, and thus the processing liquid ejection data is generated per each pixel.

Furthermore, CPU 100 can control driving of a carriage motor 107 and a paper feeder motor 108 via motor drivers 105 and 106.

On a basis of the construction set forth above, positions to which the processing liquid is ejected in relation to actual ejection data will be explained with reference to FIGS. 5 and 6. FIG. 5 diagrammatically show what data ejection of the processing liquid responds to, in relation to the original ejection data of the black ink and the cyan ink. FIG. 6 shows a detailed construction included in the data generation circuit 102, which can perform the process shown in FIG. 5.

In FIGS. 5 and 6, reference numerals 301 and 302 denote illustration of the original ejection data of the black ink and the cyan ink illustrated correspondingly to pixel positions. Also, the reference numerals 303 and 304 denote illustration of intermediate data extracted from the original ejection data according to respective predetermined rules, as similarly illustrated correspondingly to the pixels. As set forth above, in the shown embodiment, since the processing liquid is ejected for all pixels to be ejected the black ink, the rule for extracting the intermediate data 303 is a rule to make it the same as the original data 301. On the other hand, concerning the cyan original data, the predetermined rule is a rule in which the intermediate data is extracted from ejection data of respective raster in a rate of one dot per two dots in the sequential order from a first column. Concerning the intermediate data of cyan, a method disclosed in the above-identified Japanese Patent Application Laid-open No. 9-226154 (1997) is applied for performing extraction of an edge portion of an image.

For the extracted data 303 and 304 extracted for the processing liquid, intermediate data 305 and 306 are obtained as OR and AND, respectively by means of an OR gate 402 and an AND gate 401 (see FIG. 6). With respect to the intermediate data 306 resulting from the AND, process for shifting for one pixel in a column direction is performed by one dot shifting circuit 403. As a result, an intermediate data 307 is obtained. With taking OR of the intermediate data 307 and the intermediate data 305 resulting from the OR, an ejection data 308 for the processing liquid is obtained finally.

Thus, the AND is derived in addition to the OR of the extracted data respectively extracted from the ejection data of two colors of inks ejected in one scanning cycle, and from the resultant AND, a pixel, on which the intermediate data for two colors of inks overlap each other can be detected. Further, by shifting the detected overlapping pixel data for one pixel, the processing liquid can be ejected for the adjacent pixel in addition to the overlapping data pixel. As a result, even in the case where the ejection opening array shown in FIG. 3B is used, and accordingly only one dot of the processing liquid is ejected and two droplets of inks are ejected, for one pixel in one scanning cycle, shorting amount of the processing liquid necessary for making the dye in the ink insoluble can be compensated by the processing liquid ejected to the adjacent pixel. Thus, sufficient water-resistance and so on can be obtained.

It should be noted that while the foregoing explanation has been given for the case where the data 307 is obtained by shifting the data 306 obtained as OR toward the right in the column of drawing, the present invention is not limited to the shown manner of deriving the data. For example, as long as the processing liquid is being located adjacent to the pixel of the overlapping ejection data, the present invention is clearly effective even when the shifting direction is leftward or in raster direction in the column.

As set forth above, according to the shown embodiment, in the construction for ejecting the processing liquid by one the processing liquids ejection head with respect to ink ejection from two ink-jet heads in the same scanning cycle, when two ink ejection data overlap on the same pixel, sufficient water-resistance can be obtained by ejecting the processing liquid for respective one dot for the pixel and the adjacent pixel.

It should be noted that respective original data of black and cyan shown in FIG. 5 are examples for simplification of disclosure of the shown embodiment, and do not specifically identify any image. Further, pixel, on which Bk and C are overlapped, is for forming, for example, a black enhanced image.

Furthermore, data for processing liquid when the pixels on which cyan magenta or yellow ink is solely ejected, can be the processing liquid ejection data corresponding to data derived by thinning the ejection data of ink into half similar to the generation method of the cyan data 304 and by extracting the edge portion by the method disclosed in Japanese Patent Laid-open No. 9-226154 (1997), for example. Thus, when only one kind of ink is ejected to one pixel in one scanning cycle, the data derived by thinning the ejection data of the ink can be taken as data of the processing liquid.

Furthermore, when the pixel is formed by combination of two colors among cyan, magenta and yellow, by generating the ejection data of the processing liquid by the method shown in FIG. 5, the processing liquid can be ejected to the pixel, on which two colors overlap and the adjacent pixel. In this case, as in the foregoing case with respect to black and cyan, the amount of the processing liquid becomes relatively large. Thus, sufficient water-resistance can be obtained, similarly.

In the shown embodiment, OR data and AND data are derived by means of structure shown in FIGS. 4 and 5. However, these data (that is, ejection data for the head) may be generated in a host apparatus such as a personal computer, and in the printing apparatus, these data may be only supplied to the head. Similar discussion may be applied to embodiment explained below.

Second Embodiment

The construction of the shown embodiment of the head is similar to the former first embodiment and thus the one shown in FIG. 3B may be employed. Also, the printing apparatus shown in FIG. 1 is employed.

Figure 7:
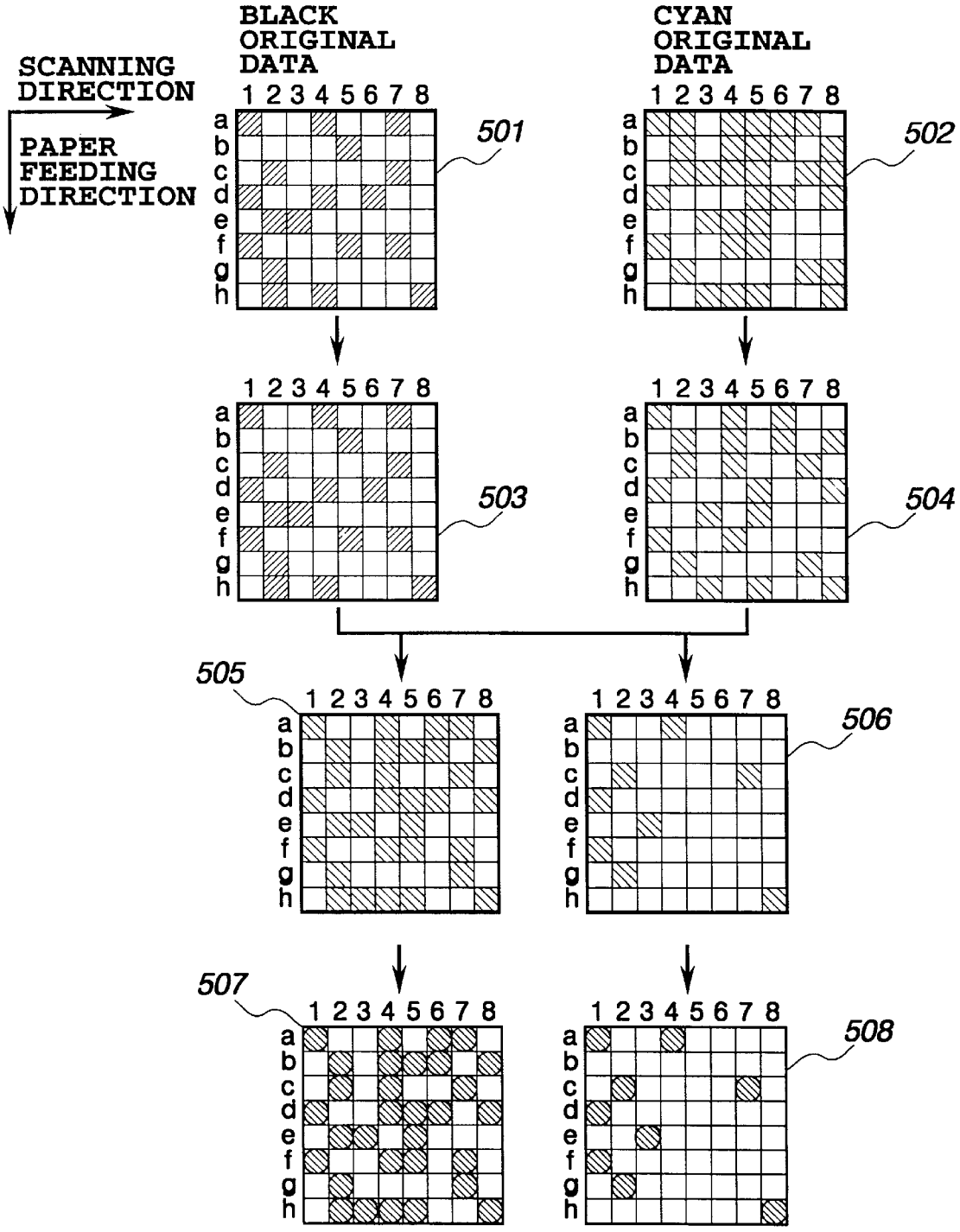
FIG. 7 is an illustration for explaining generation of a processing liquid data in a second embodiment of the present invention.
Figure 8:
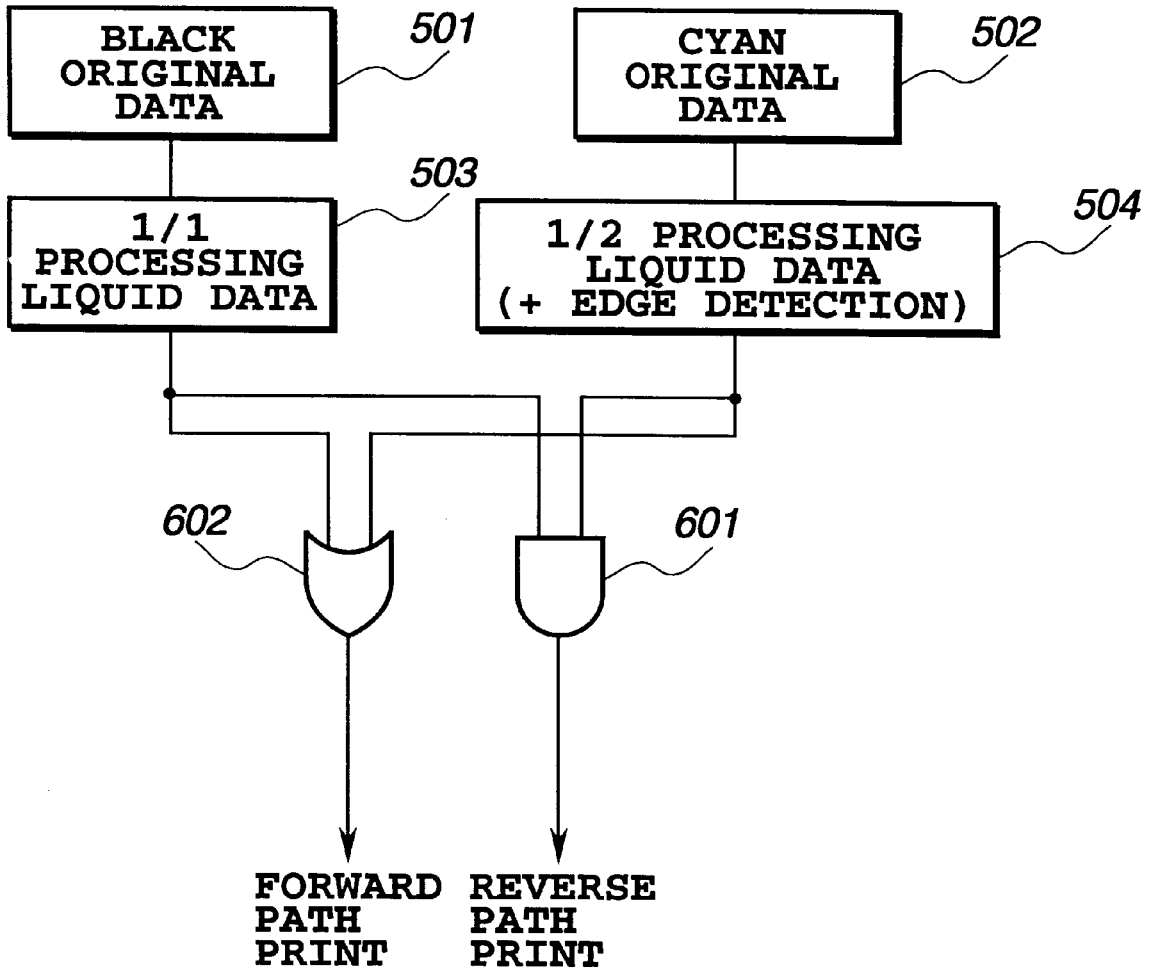
FIG. 8 is a block diagram of a construction for generating the processing liquid data shown in FIG. 7.

The manner of ejection of the processing liquid with respect to the ejection data of respective inks will be explained with reference to FIGS. 7 and 8. FIG. 7 is similar to FIG. 5 and diagrammatically shows, to which pixel the processing liquid is ejected with respect to respective original ejection data of black and cyan. Also, FIG. 8 is a block diagram showing a construction for performing the process of FIG. 7, which shows a construction included in the data generation circuit 102 of FIG. 4.

In the shown embodiment, an intermediate data 505 as resulting from OR (OR gate 602 of FIG. 8) shown in FIG. 7 and an intermediate data 506 as resulting from AND (AND gate 601 of FIG. 8) are respectively stored independently. The data 505 as a result of OR is taken as a processing liquid ejection data 507 in a forward scan of the head. On the other hand, the data 506 as a result of AND is taken as the processing liquid ejection data in a reverse scan of the head. Then, at a timing where the reciprocal scan is completed, paper feeding for 80 pixels is performed.

Thus, by taking OR and AND independently and performing ejection of the processing liquid dividingly for a forward path and a reverse path on a basis of the resultant data, with respect to the pixel detected as a result of AND, namely to the pixel requiring the processing liquid for two dots, insufficient amount of the processing liquid amount ejected in the forward scanning can be compensated by ejection of the processing liquid in the reverse scan. Thus, sufficient water-resistance can be obtained.

Figure 3A:
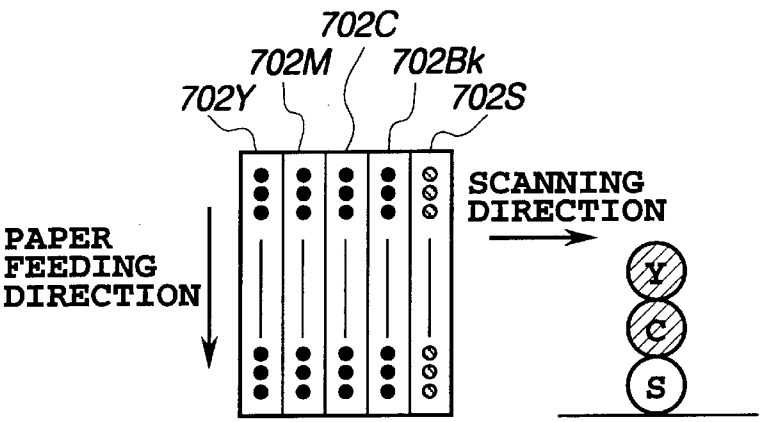
Figure 3D:
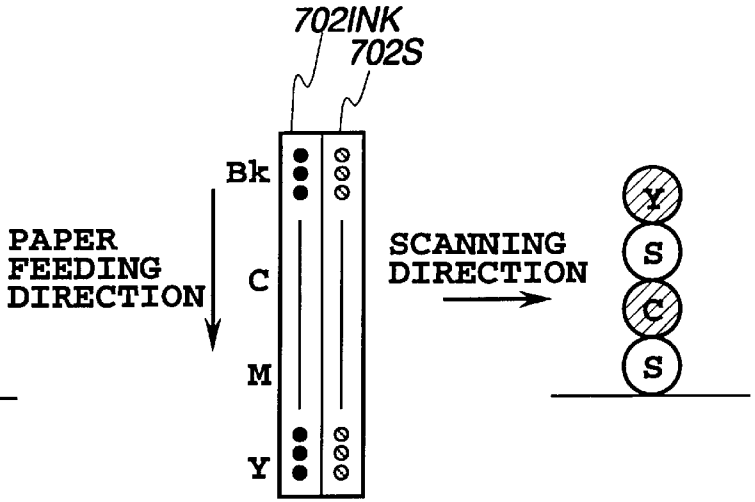
Figure 3C:
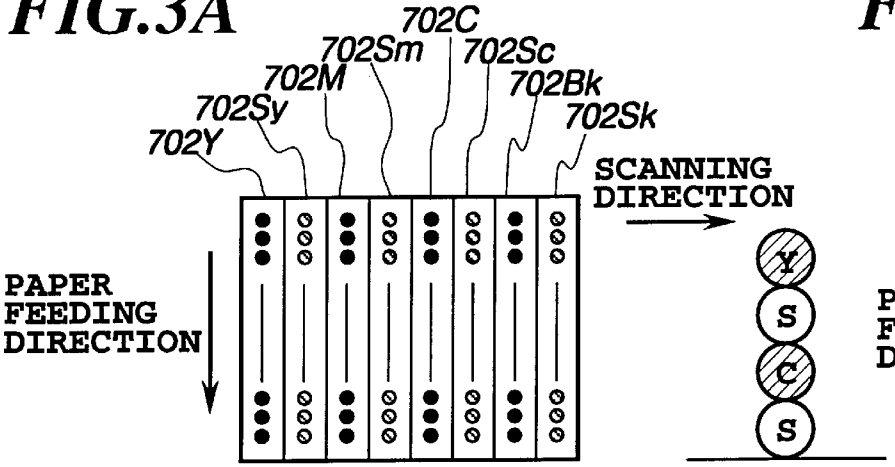

In the foregoing explanation, while an example has been given for the case where the head of the construction shown in FIG. 3B is employed, the present invention is effective even in the construction shown in FIG. 3A. In this head construction, one processing liquid ejection head 702S has to be adapted for the heads 702B, 702C, 702M and 702Y for all four colors. In this case, the pixel (OR), in which at least one color of ink requires the processing liquid, and the pixel (AND), in which two or more colors of inks require the processing liquid, are extracted independently, and a method is taken to perform ejection for the former pixel in the forward direction and for the later pixel in the reverse direction.

Furthermore, depending upon an image processing method, it becomes possible that the shown embodiment adapts even for the case where three or four colors of inks are all overlapped on one pixel. More specifically, in the case that scanning of four times (two cycles of reciprocal scan) is performed for one time of paper feeding, the four times of scanning may be divided into scanning for ejection of the processing liquid for the pixel on which one or more inks are overlapped, scanning for ejection of the processing liquid for the pixel on which two or more inks are overlapped, scanning for ejection of the processing liquid for the pixel on which three or more inks are overlapped, and scanning for ejection of the processing liquid for the pixel on which all four inks are overlapped to perform printing.

It should be noted that while reciprocal or bi-directional printing as set forth above is effective when importance is given for throughput of printing operation, it is possible to perform both of scanning of OR data and scanning of AND data by forward scanning when precision of matching of printing position in forward path and reverse path is low or when reverse printing is inappropriate in view of memory management or in other reason.

As set forth above, according to the shown embodiment, in the construction where the processing liquid is ejected by one processing liquid ejection head for ink ejection from two or more ink-jet heads in the same scan, when two or more dots of the processing liquid ejection data overlap for the same pixel, the processing liquid may be ejected per one dot for each of a plurality of times of scanning to obtain sufficient water-resistance.

Third Embodiment

The ink-jet head in the shown embodiment is similar to that employed in the first embodiment, and similar to the foregoing second embodiment.

Figure 9:
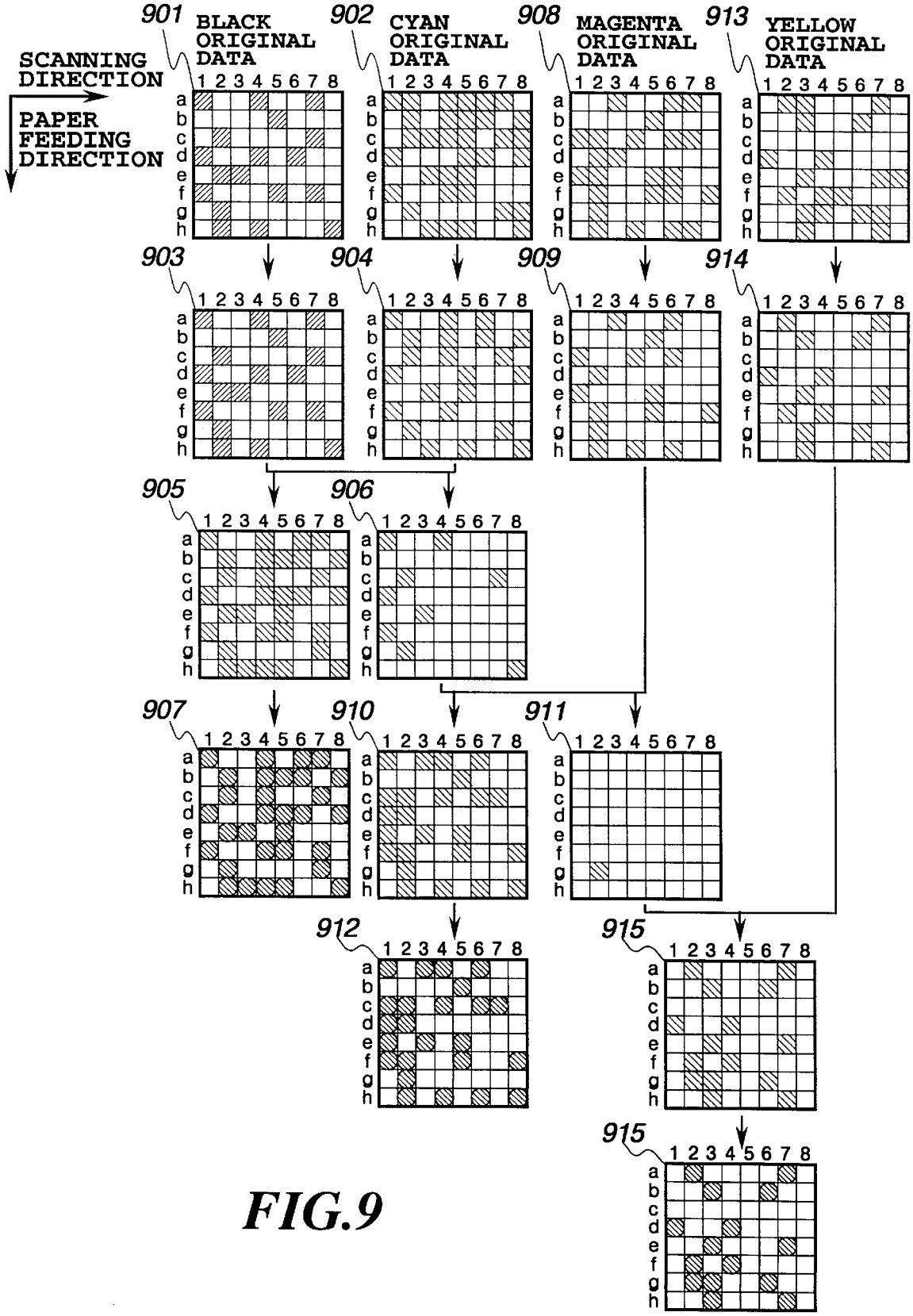
FIG. 9 is an illustration for explaining generation of a processing liquid data in the third embodiment of the present invention.
Figure 10:
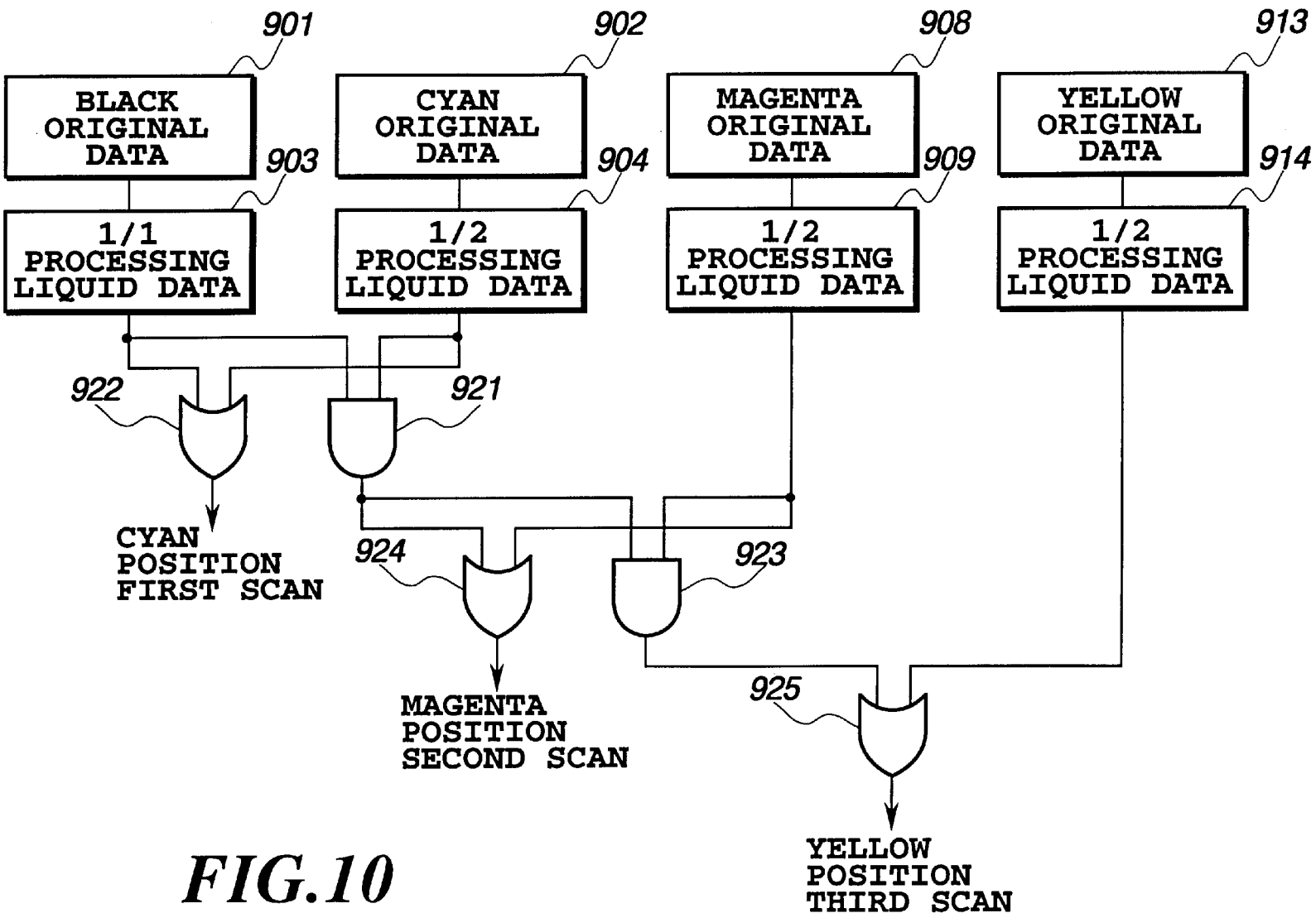
FIG. 10 is a block diagram of a construction for generating the processing liquid data shown in FIG. 9.

For ejection data of respective color inks, the manner of ejection of the processing liquid will be explained with reference to FIGS. 9 and 10 similarly to respective of the former embodiments. FIG. 9 diagrammatically shows how the processing liquid is ejected corresponding to the original ejection data of respective four colors. FIG. 10 is a block diagram showing a construction for performing the process shown in FIG. 9.

In the shown embodiment, intermediate data 905 as resulting from OR (OR gate 922 of FIG. 10) and intermediate data 906 as resulting from AND (AND gate 921 of FIG. 10) respectively derived from extracted data 903 and 904 which are extracted from ejection data 901 and 902 of cyan and black respectively, are stored independently. The intermediate data 905 as OR data is taken as data 907 for ejecting the processing liquid in the first scan with use of 80 ejection openings at the same positions as those of the ejection openings for cyan ink. Also, in this scan, black and cyan inks are ejected. Ejection for the intermediate data 906 as AND data through the ejection openings at the corresponding positions is not performed.

After paper feeding in amount corresponding to 80 pixels, in the next scan, the magenta ink and the processing liquid corresponding to the magenta ink are ejected to the region where the black and cyan inks and the corresponding processing liquid were ejected in the former scan. More specifically, the intermediate data generated from the ejection data 908 of magenta becomes data 909. The method for generating the intermediate data 909 is similar to that for generating the processing liquid ejection data for cyan as set forth above in the explanation for the first embodiment. On a basis of the intermediate data 909 thus extracted and the foregoing AND data 906, OR data 910 and AND data 911 are calculated (an OR gate 924 and an AND gate 923 in FIG. 10). Then, the OR data 910 is taken as ejection data 912 for ejecting the processing liquid through 80 ejection openings at corresponding positions to the ejection openings for the magenta ink. Ejection on a basis of the AND data to the corresponding positions is not performed.

After paper feeding in amount corresponding to 80 pixels, in the third scan, the yellow ink and the processing liquid corresponding to the yellow ink are ejected to the region where the magenta ink and the corresponding processing liquid were ejected in the former second scan. More specifically, intermediate data 914 for the processing liquid is extracted from the ejection data 913 of yellow. On a basis of the intermediate data 914 thus extracted and the foregoing AND data 911, OR data 915 is calculated (an OR gate 925 of FIG. 10). The result is taken as data for performing ejection of the processing liquid in the third scan with use of 80 ejection openings for the processing liquid at the corresponding positions to the ejection openings for the yellow ink, and the yellow ink and the processing liquid are ejected as shown in 915*a* to complete printing for 80 pixels.

As set forth above, in the pixel where the intermediate data for the processing liquid overlap in respective scan corresponding to respective colors of inks, sufficient water-resistance can be obtained by using the result of AND indicative of overlapping as the processing liquid ejection data for the next scan so that showing amount of the processing liquid is compensated by subsequent scan while the processing liquid for two dots is not ejected corresponding to two dots of inks for the same pixel in one scan.

It should be noted that in the construction of the shown embodiment as set forth above, since AND of the data 911 and data 914 shown in FIG. 9 is not derived, the amount of the processing liquid possibly becomes reduced when four inks are overlapped on the same pixel. However, possibility of occurrence of such data in the practical operation is small and, the shown embodiment is constructed as set forth above.

Fourth Embodiment

The shown embodiment is an application of the present invention for a divided printing system explained hereinafter.

The ink-jet head should have slight tolerance per each individual ejection openings for tolerance in the fabrication process. Such tolerance should influence for ejection amount and ejecting direction upon performing ejection, which results in fluctuation of density on the printed image to degrade the printed image quality.

As a measure for occurrence of fluctuation of printing density, the following method has been known. The method will be explained hereinafter in terms of the head constructed with 8 ejection openings, with reference to FIGS. 11A to 11C. In this case, among the 8 ejection openings in the head, the upper 4 ejection openings and the lower 4 ejection openings respectively correspond to two different printing regions. The dots formed in the one scan by respective four ejection openings are derived by thinning the image data by approximately half.

Considering one printing region, the data thinned to about half is printed through the lower 4 ejection openings in the first scan. Then, paper feeding is performed for a distance corresponding to the 4 ejection opening length. Subsequently, in the second scan, remaining half of non-printed data is printed by the upper 4 ejection openings to complete printing in the corresponding region. Similarly, by alternately performing scanning using 4 ejection openings and paper feeding for 4 ejection openings, an image is formed on the printing surface. The foregoing printing method is hereinafter referred to as divided printing or multi-scan printing.

Figure 11C:
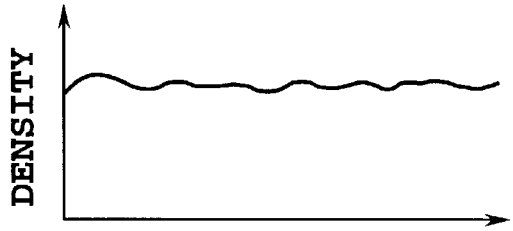
FIGS. 11A to 11C are illustrations for explaining a divided printing method according to a fourth embodiment of the present invention.
Figure 11B:
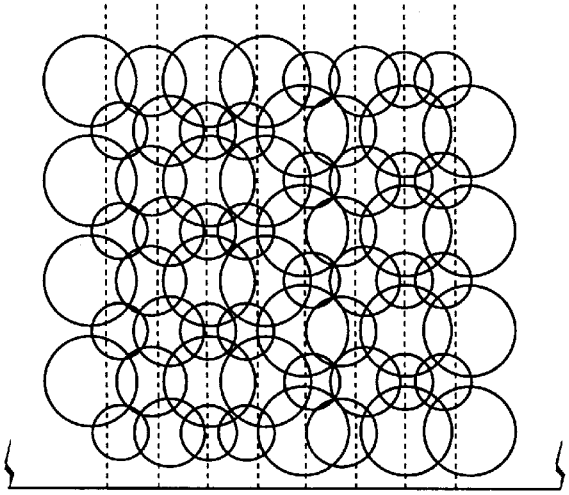
Figure 11A:
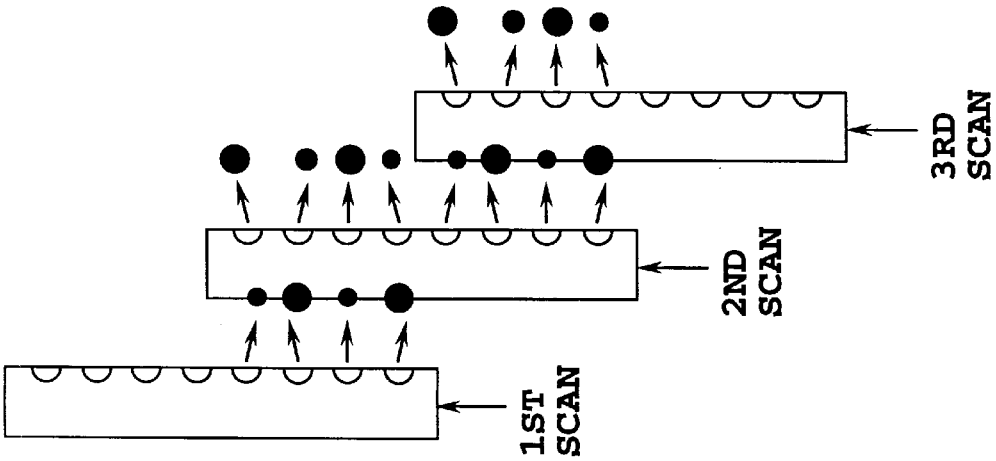

By employing such a printing method, the influence of ejection characteristics specific in each ejection opening can be reduced. Thus, the printed image becomes as shown in FIG. 11B to make black stripe or white strip not perceptible. Accordingly, fluctuation of density of the image can be reduced as shown in FIG. 11C.

In order to effectively perform the above-described divided printing, it is desirable that the printing data aligned in the raster direction can always divide evenly in respective scan. As a method for realizing this, there is the so-called sequential multi-scan (hereinafter referred to as SMS) as disclosed in Japanese Patent Application Laid-Open No. 5-330083 (1993) or Japanese Patent Application No. 8-72615 (1996), for example. By this multi-scan method, the print data aligned in the raster direction (scanning direction of the carriage) is sequentially assigned to a plurality of printing elements of the head. Therefore, for any arrangement of print data, the dots aligned in the raster direction (primary scanning direction) in the printed image can be formed by an evenly assigned plurality of printing elements. Further, as viewed from the printing elements, since number of ejections can be distributed substantially even for all printing elements, local concentration of the number of ejections in the head can be avoided and lift of the head can be maximized.

Figure 12:
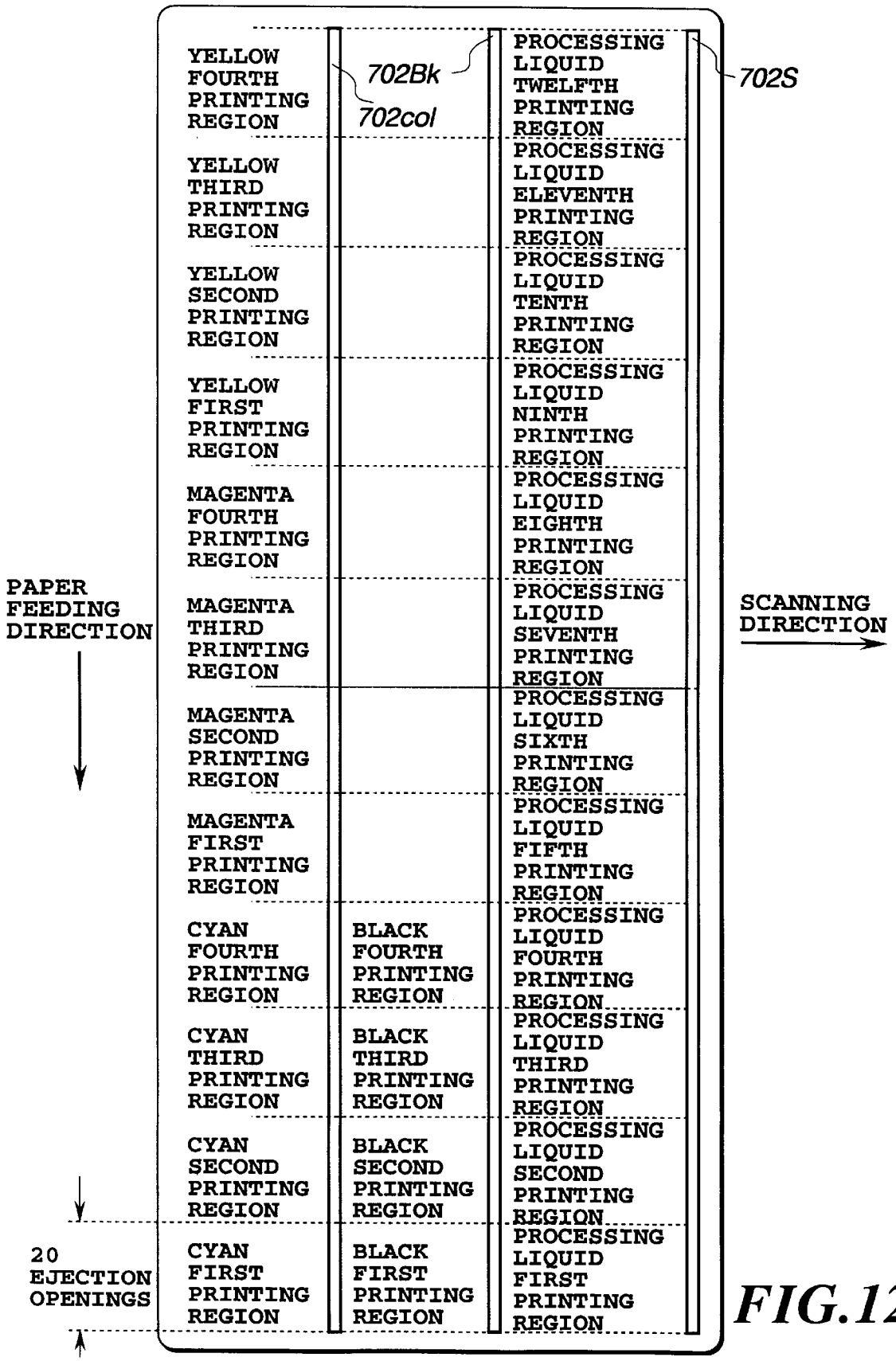
FIG. 12 is an illustration showing the divided printing method with a printing region on a printing paper.

In the shown embodiment, the head shown in FIG. 3B is employed. In this case, 80 ejection openings are divided into four groups of respective 20 ejection openings corresponded to four printing regions. Namely, as shown in FIG. 12, in sequential order to perform printing for respective color inks, first printing region, second printing region, third printing region and fourth printing regions are dividingly defined. These regions correspond to ejection openings of respective ink by paper feeding for 20 pixels. It should be noted that FIG. 12 shows which ejection openings are used for printing each of the first to fourth printing regions but dots not show that printing for a respective printing region shown in FIG. 12 is performed or a different region of the printing paper.

Figures 13, 13A:
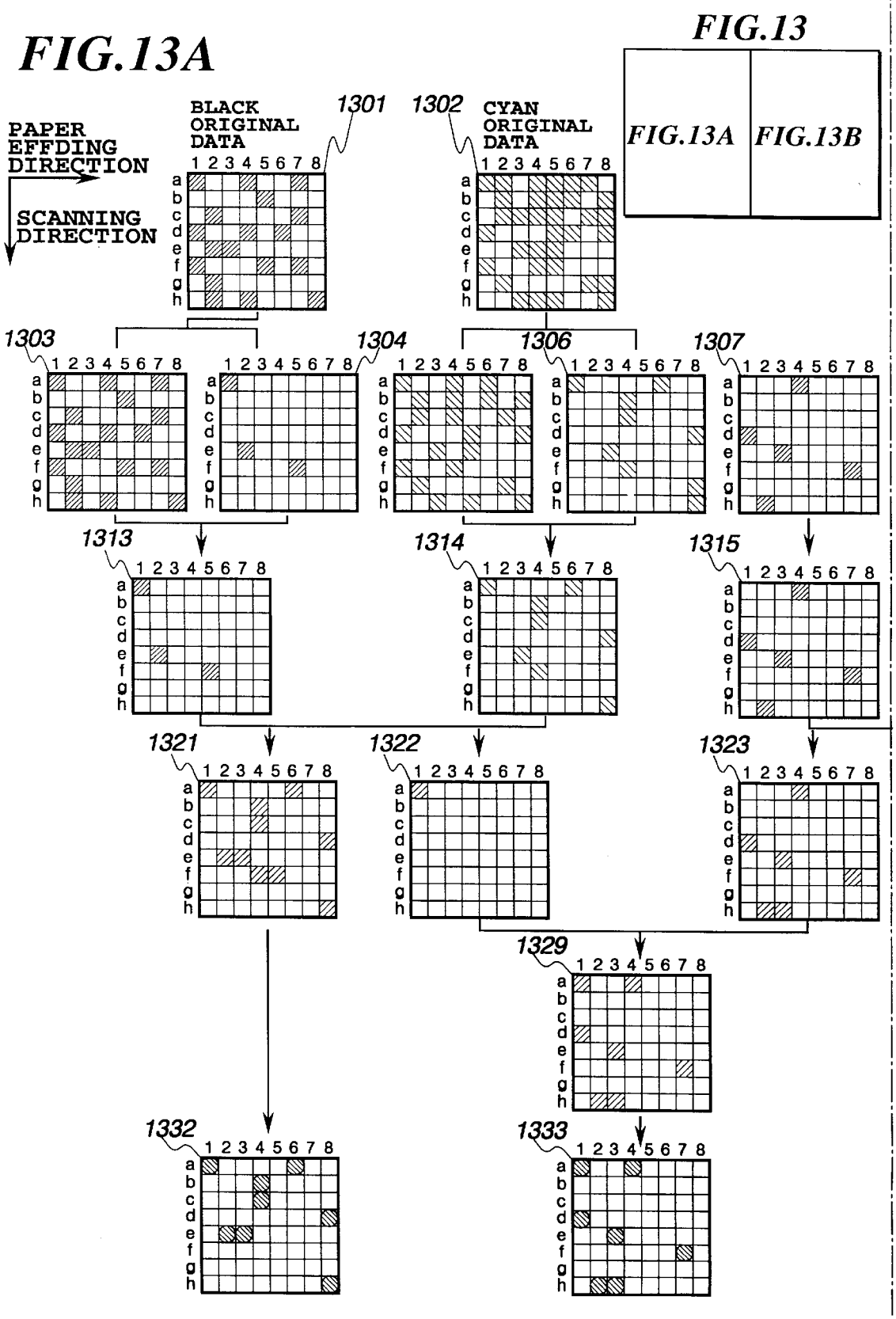
FIG. 13 is an illustration for explaining generation of the processing liquid data in the fourth embodiment of the present invention.
FIGS. 13A and 13B are drawings made by dividing FIG. 13 into two portions.
Figure 13B:
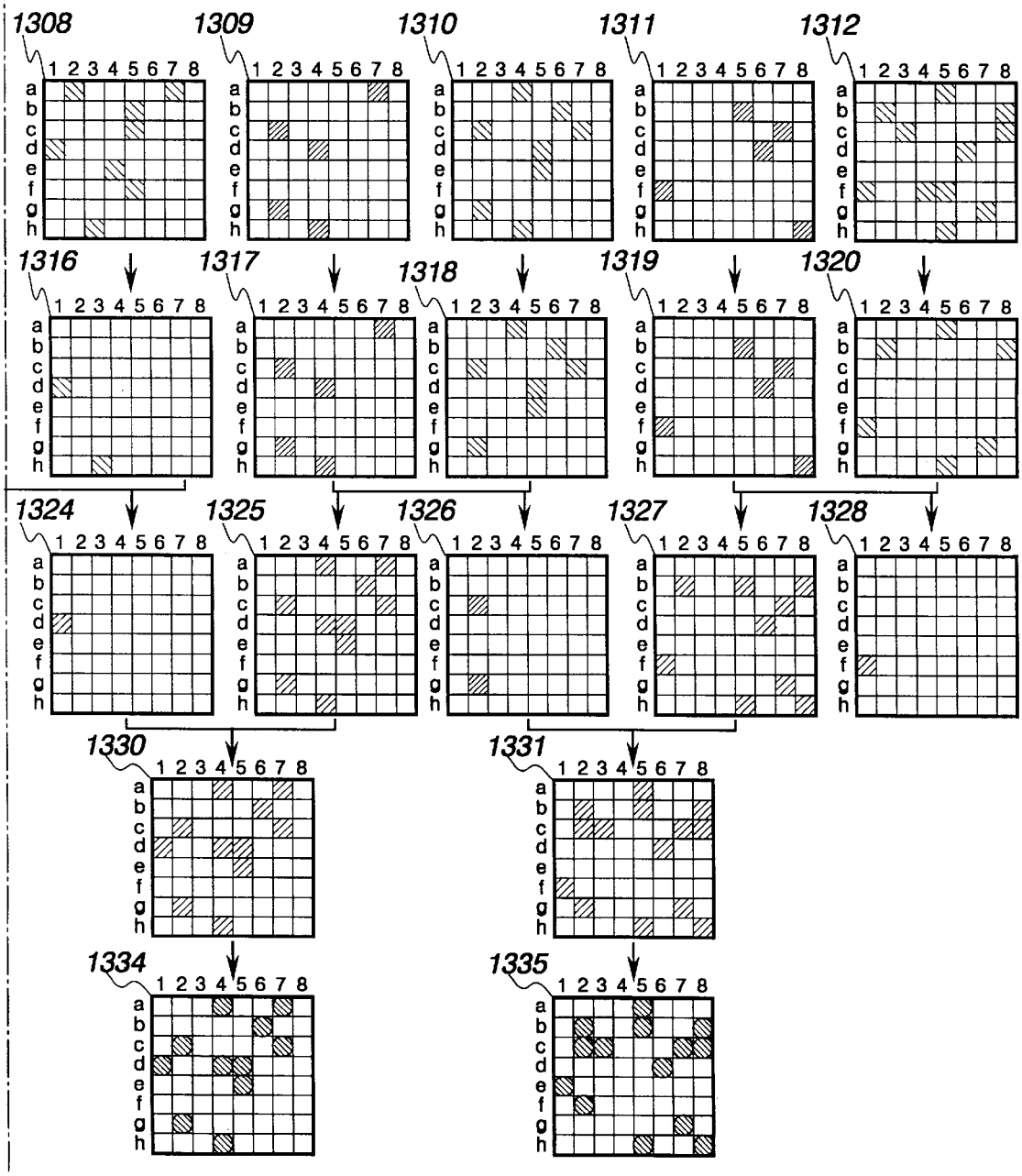
Figure 14:
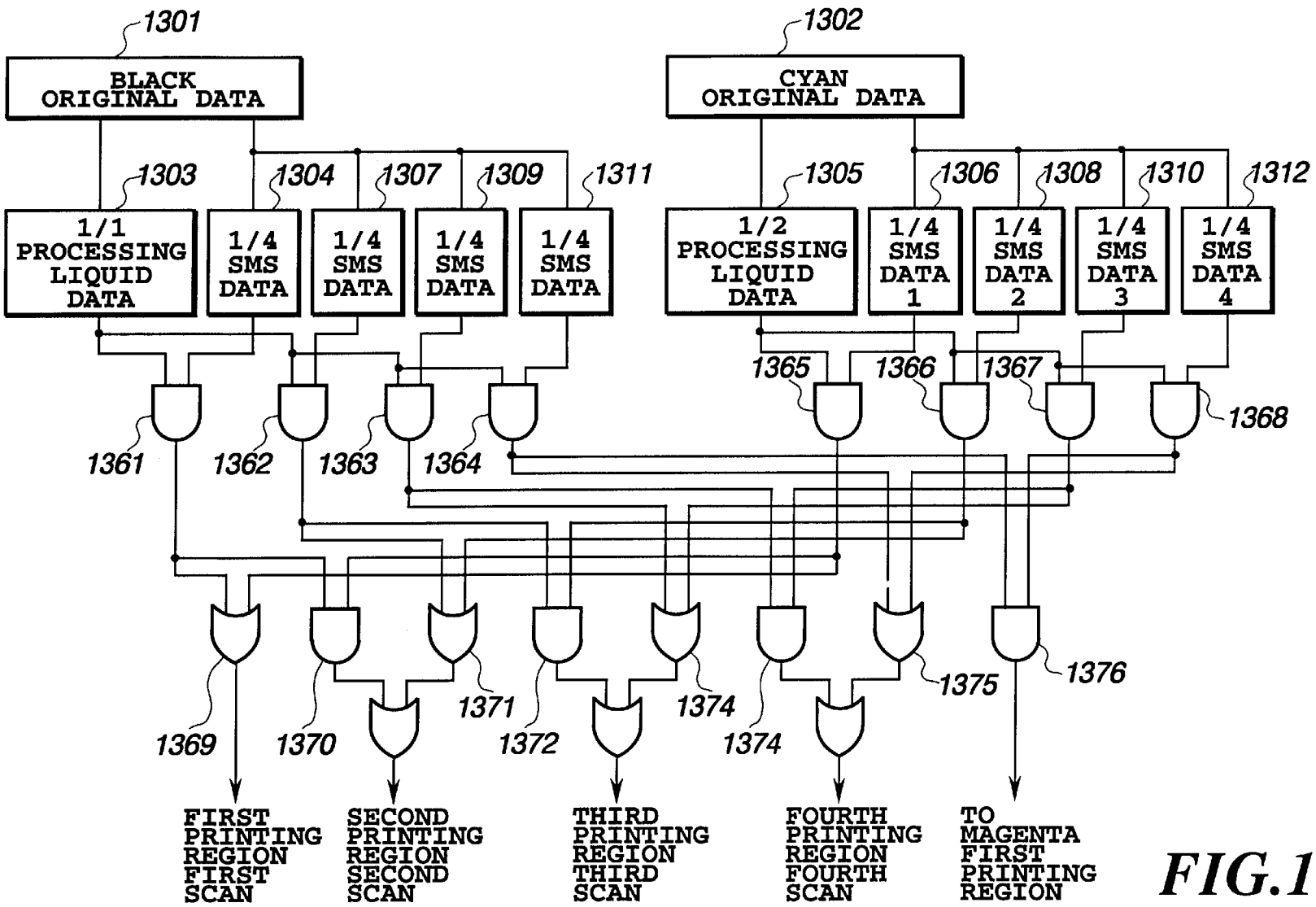
FIG. 14 is a block diagram showing a construction for generating the processing liquid data shown in FIG. 13.

In the shown embodiment, a manner for determining pixels, corresponding to which the processing liquid is to be ejected will be explained with reference to FIGS. 13A, 13B and 14 similarly to the foregoing embodiments. FIGS. 13A and 13B are diagrammatic illustrations showing, to which pixel the processing liquid is to be ejected. FIG. 14 is a block diagram showing a construction for performing the process shown in FIGS. 13A and 13B, the construction of which is incorporated in the data generation circuit 102.

Corresponding to first to fourth printing regions with respect to black and cyan, respective extracted data 1304, 1307, 1309 and 1311 for black and extracted data 1306, 1308, 1310 and 1312 for cyan for performing SMS are derived by thinning original data 1301 and 1302 for black and cyan into one fourth. These thinned data are in a mutually complementary relationship so that the original data 1301 and 1302 can be obtained by synthesizing these thinned data. The heads for respective inks of black and cyan eject respective inks based on these thinned data in a corresponding scan, whereas the intermediate data for ejection of the processing liquid will be further processed as follow.

The data 1303 and 1306 are extracted data extracted from respective original data similarly to respective or foregoing embodiment. More specifically, the intermediate data 1303 for black is the original data as is, and the intermediate data 1306 for cyan is derived by thinning the data in half with edge extraction. The data 1313 is the AND of the data 1303 and data 1304, which represents the intermediate data for black to be ejected in the first scan. Similarly, the data 1314 represents the intermediate data for cyan to be ejected in the first scan. With taking OR and AND of these data 1313 and 1314, the result 1321 of an OR operation thereof is data which is to be actually ejected by the head for the processing liquid in the first scan. On the basis of this data and the ejection data 1304 and 1306 for the ink, the first scan in the first printing region is performed. On the other hand, the result 1322 of the AND operation is used as data for the second scan.

Concerning SMS data 1307 and 1308 to be used as ejection data of black and cyan in the second printing region, similar to the case of the first printing region, the AND of the intermediate data 1307 and 1308 is derived. The resultant AND data 1315 and 1316 thus obtained represent the second intermediate data of the processing liquid. Similarly to that for the first printing region, OR data and AND data are derived from these data. Data 1323 obtained by OR operation becomes the intermediate data for the processing liquid of the second scan. The OR operation is also performed with respect to the data 1323 and the result 1322 of the AND derived in operation in the first printing region. Then, data 1329 obtained from the OR operation finally becomes the ejection data 1333 for the processing liquid of the second printing region. On the other hand, the result of AND operation of the data 1315 and 1316 is used as data for the third printing region.

SMS data 1309 and 1310 to be used as ejection data of black and cyan in the third printing region, similar to the case of the first printing region, the AND operation of the intermediate data 1303 and 1305 is performed. The resultant AND data 1317 and 1318 thus obtained represent the intermediate data of the processing liquid for the third scan. Then, OR data and AND data are derived from these data, and the result and the OR data 1325 becomes the intermediate data of the processing liquid for the third scan. On the other hand, OR operation is also performed with respect to this data 1325 and the result data 1324 of AND derived in operation in the second printing region. Then, data 1330 obtained from the OR operation finally becomes the ejection data 1334 of the processing liquid for the third printing region. On the other hand, the result of the AND operation of the data 1317 and 1318 is used as data for the next, fourth printing region.

Finally, SMS data 1311 and 1312 to be used as ejection data of black and cyan in the fourth printing region, similar to the case of the the former printing regions, the AND of the intermediate data 1311 and 1312 is derived. The resultant AND data 1319 and 1320 thus obtained represent the intermediate data of the processing liquid for the fourth scan. OR data and AND data are derived from these data. The result 1327 of the OR derived is the intermediate data of the processing liquid to be used in the fourth scan. Then, the OR operation of the data 1327 and the result 1326 of the AND obtained through the process for the third printing region as set forth above, is performed. Data 1331 thus obtained becomes data of the processing liquid to be finally ejected data 1335 to the fourth printing region. On the other hand, the result 1328 of the AND of data 1319 and 1320 is used for process of the first printing region of magenta as data for next scan.

Upon performing divided printing in the manner set forth above, AND data derived with respect to each printing region of the head is fed to the process in the next printing region. Thus, even when two dots of the processing liquid have to be ejected for the same pixel in the same operation cycle, the reduced amount of the processing liquid can be compensated in the subsequent scan. Therefore, sufficient water-resistance can be obtained.

It should be noted that while the shown embodiment employs a construction wherein the result of the AND operation derived for the fourth printing region of black and cyan is used for process of the first printing region of magenta, if the AND data thus transferred overlaps with the processing liquid ejection data for magenta in the first printing region of magenta, the AND data may be shifted to the second printing region of magenta. Even in this case, there is little chance that the AND data derived in the fourth printing region of black and cyan is shifted up to the first printing region of yellow.

As set forth above, according to the present embodiment, upon performing divided printing employing the head having a construction as shown in FIG. 3B, by taking the results of the OR operation in each scan as the ejection data for the processing liquid ejection head and by using the result of the AND operation in scan of the adjacent printing region. Reduced amount of the processing liquid for making dye in the ink insoluble as being required ejection of two dots of the processing liquid for the same pixel in practice, can be compensated by other scanning cycle. Thus, sufficient water-resistance can be obtained.

While the shown embodiment takes a method to shift the data derived through AND operation to an adjacent printing region, it may be possible to form an additional dot of the processing liquid in the adjacent pixel similar to the first embodiment. In the alternative, it may be possible to perform ejection on the basis of the AND data in reciprocal or bi-directional printing or separate scan, as in the second embodiment.

Here, as an example, the processing liquid or solution for making ink dyestuff insoluble can be obtained in the following manner.

Specifically, after the following components are mixed together and dissolved, and the mixture is pressure-filtered by using a membrane filter of 0.22 $\mu$m in pore size (tradename: fuloropore filter manufactured by Sumitomo Electric Industries, Ltd.), and thereafter, pH of the mixture is adjusted to a level of 4.8 by adding sodium hydroxide whereby liquid A1 can be obtained.

components of A1 low molecular weight ingredients of cationic compound;

| | |
|---|---|
| stearyl-trimethyl ammonium salts (tradename: Electrostriper QE, manufactured by Kao Corporation), or stearyl-trimethyl ammonium chloride (tradename: Yutamine 86P, manufactured by Kao Corporation) | 2.0 parts by weight |

high molecular weight ingredients of cationic compound;

| | |
|---|---|
| copolymer of diarylamine hydrochloride and sulfur dioxide (having an average molecular weight of 5000) (tradename: polyaminesulfon PAS-92, manufactured by Nitto Boseki Co., Ltd) | 3.0 parts by weight |
| thiodiglycol; | 10 parts by weight |
| water | balance |

Preferable examples of ink which becomes insoluble by mixing the aforementioned processing liquid can be noted below.

Specifically, the following components are mixed together, the resultant mixture is pressure-filtered with the use of a membrane filter of 0.22 $\mu$m in pore size (tradename: Fuloroporefilter, manufactured by Sumitomo Electric Industries, Ltd.) so that yellow ink Y1, magenta ink M1, cyan ink C1 and black ink K1 can be obtained.

| | |
|---|---|
| Y1 | |
| C. I. direct yellow 142 | 2 parts by weight |
| thiodiglycol | 10 parts by weight |
| acetynol EH (tradename: manufactured by Kawaken Fine Chemical Co., Ltd.) | 0.05 parts by weight |
| water | balance |
| M1 | |

having the same composition as that of Y1 other than that the dyestuff is changed to 2.5 parts by weight of C. I. acid red 289.

C1 having the same composition as that of Y1 other than that the dyestuff is changed to 2.5 parts by weight of acid blue 9.

K1 having the same composition as that of Y1 other than that the dyestuff is changed to 3 parts by weight of C. I. food black 2.

According to the present invention, the aforementioned processing liquid and ink are mixed with each other at the position on the printing medium or at the position where they penetrate in the printing medium. As a result, the ingredient having a low molecular weight or cationic oligomer among the cationic material contained in the processing liquid and the water soluble dye used in the ink having anionic radical are associated with each other by an ionic mutual function as a first stage of reaction whereby they are instantaneously separated from the solution liquid phase.

Next, since the associated material of the dyestuff and the cationic material having a low molecular weight or cationic oligomer are adsorbed by the ingredient having a high molecular weight contained in the processing liquid as a second stage of reaction, a size of the aggregated material of the dyestuff caused by the association is further increased, causing the aggregated material to hardly enter fibers of the printed material. As a result, only the liquid portion separated from the solid portion permeates into the printed paper, whereby both high print quality and a quick fixing property are obtained. At the same time, the aggregated material formed by the ingredient having a low molecular weight or the cationic oligomer of the cationic material and the anionic dye by way of the aforementioned mechanism, has increased viscosity. Thus, since the aggregated material does not move as the liquid medium moves, ink dots adjacent to each other are formed by inks each having a different color at the time of forming a full colored image but they are not mixed with each other. Consequently, a malfunction such as bleeding does not occur. Furthermore, since the aggregated material is substantially water-insoluble, water resistibility of a formed image is complete. In addition, light resistibility of the formed image can be improved by the shielding effect of polymer.

By the way, the term "insoluble" or "aggregation" refers to observable events in only the above first stage or in both the first and second stages.

When the present invention is carried out, since there is no need of using the cationic material having a high molecular weight and polyvalent metallic salts like the prior art or even though there is need of using them, it is sufficient that they are assistantly used to improve an effect of the present invention, a quantity of usage of them can be minimized. As a result, the fact that there is no reduction of a property of color exhibition that is a problem in the case that an effect of water resistibility is asked for by using the conventional cationic high molecular weight material and the polyvalent metallic salts can be noted as another effect of the present invention.

Ink usable for carrying out the present invention should not be limited only to dyestuff ink, and pigment ink having pigment dispersed therein can also be used. Any type of processing liquid can be used, provided that pigment is aggregated with it. The following pigment ink can be noted as an example of pigment ink adapted to cause aggregation by mixing with the processing liquid A1 previously discussed. As mentioned below, yellow ink Y2, vp 5magenta ink M2, cyan ink C2 and black ink K2 each containing pigment and anionic compound can be obtained.

Black ink K2

The following materials are poured in a batch type vertical sand mill (manufactured by Aimex Co.), glass beads each having a diameter of 1 mm is filled as media using anion based high molecular weight material P-1 (aqueous solution containing a solid ingredient of styrene methacrylic acid ethylacrylate of 20% having an acid value of 400 and average molecular weight of 6000, neutralizing agent potassium hydroxide) as dispersing agent to conduct dispersion treatment for three hours while water-cooling the sand mill. After completion of dispersion, the resultant mixture has a viscosity of 9 cps and pH of 10.0. The dispersing liquid is poured in a centrifugal separator to remove coarse particles, and a carbon black dispersing element having a weight-average grain size of 10 nm is produced.

| (Composition of carbon black dispersing element) | |
|---|---|
| P-1 aqueous solution (solid ingredient of 20%) | 40 parts |
| carbon black Mogul L (tradename: manufactured by Cablack Co.) | 24 parts |
| glycerin | 15 parts |
| ethylene glycol monobutyl ether | 0.5 parts |
| isopropyl alcohol | 3 parts |
| water | 135 parts |

Next, the thus obtained dispersing element is sufficiently dispersed in water, and black ink K2 containing pigment for ink jet printing is obtained. The final product has a solid ingredient of about 10%.

Yellow ink Y2

Anionic high molecular P-2 (aqueous solution containing a solid ingredient of 20% of stylen-acrylic acid methyl methacrylic having an acid value of 280 and an average molecular weight of 11,000, neutralizing agent:diethanolamine) is used as a dispersing agent and dispersive treatment is conducted in the same manner as production of the black ink K2 whereby yellow color dispersing element having a weight-average grain size of 103 nm is produced.

| (composition of yellow dispersing element) | |
|---|---|
| P-2 aqueous solution (having a solid ingredient of 20%) | 35 parts |
| C. I. pigment yellow 180 (tradename: Nobapalm yellow PH-G, manufactured by Hoechst Aktiengesellschaft Co.) | 24 parts |
| triethylen glycol | 10 parts |
| diethylenglycol | 10 parts |
| ethylene glycol monobutylether | 1.0 parts |
| isopropyl alcohol | 0.5 parts |
| water | 135 parts |

The thus obtained yellow dispersing element is sufficiently dispersed in water to obtain yellow ink Y2 for ink jet printing and having pigment contained therein. The final product of ink contains a solid ingredient of about 10%.

Cyan ink C2

Cyan colored-dispersant element having a weight-average grain size of 120 nm is produced using anionic high molecular P-1 as dispersing agent, and moreover, using the following materials by conducting dispersing treatment in the same manner as the carbon black dispersing element.

| (composition of cyan colored-dispersing element) | |
|---|---|
| P-1 aqueous solution (having solid ingredient of 20%) | 30 parts |
| C. I. pigment blue 153 (tradename: Fastogen blue FGF, manufactured by Dainippon Ink And Chemicals, Inc.) | 24 parts |
| glycerin | 15 parts |
| diethylenglycol monobutylether | 0.5 parts |
| isopropyl alcohol | 3 parts |
| water | 135 parts |

The thus obtained cyan colored dispersing element is sufficiently stirred to obtain cyan ink C2 for ink jet printing and having pigment contained therein. The final product of ink has a solid ingredient of about 9.6%.

Magenta ink M2

Magenta color dispersing element having a weight-average grain size of 115 nm is produced by using the anionic high molecular P-1 used when producing the black ink K2 as dispersing agent, and moreover, using the following materials in the same manner as that in the case of the carbon black dispersing agent.

| (composition of the magenta colored dispersing element) | |
|---|---|
| P-1 aqueous solution (having a solid ingredient of 20%) | 20 parts |
| C. I. pigment red 122 (manufactured by Dainippon Ink And Chemicals, Inc.) | 24 parts |
| glycerin | 15 parts |
| isopropyl alcohol | 3 parts |
| water | 135 parts |

Magenta ink M2 for ink jet printing and having pigment contained therein is obtained by sufficiently dispersing the magenta colored dispersing element in water. The final product of ink has a solid ingredient of about 9.2%. The present invention achieves distinct effect when applied to a recording head or a recording apparatus which has means for generating thermal energy such as electrothermal transducers or laser light, and which causes changes in ink by the thermal energy so as to eject ink. This is because such a system can achieve a high density and high resolution recording.

A typical structure and operational principle thereof is disclosed in U.S. Pat. Nos. 4,723,129 and 4,740,796, and it is preferable to use this basic principle to implement such a system. Although this system can be applied either to on-demand type or continuous type ink jet recording systems, it is particularly suitable for the on-demand type apparatus. This is because the on-demand type apparatus has electrothermal transducers, each disposed on a sheet or liquid passage that retains liquid (ink), and operates as follows: first, one or more drive signals are applied to the electrothermal transducers to cause thermal energy corresponding to recording information; second, the thermal energy induces sudden temperature rise that exceeds the nucleate boiling so as to cause the film boiling on heating portions of the recording head; and third, bubbles are grown in the liquid (ink) corresponding to the drive signals. By using the growth and collapse of the bubbles, the ink is expelled from at least one of the ink ejection orifices of the head to form one or more ink drops. The drive signal in the form of a pulse is preferable because the growth and collapse of the bubbles can be achieved instantaneously and suitably by this form of drive signal. As a drive signal in the form of a pulse, those described in U.S. Pat. Nos. 4,463,359 and 4,345,262 are preferable. In addition, it is preferable that the rate of temperature rise of the heating portions described in U.S. Pat. No. 4,313,124 be adopted to achieve better recording.

U.S. Pat. Nos. 4,558,333 and 4,459,600 disclose the following structure of a recording head, which is incorporated to the present invention: this structure includes heating portions disposed on bent portions in addition to a combination of the ejection orifices, liquid passages and the electrothermal transducers disclosed in the above patents. Moreover, the present invention can be applied to structures disclosed in Japanese Patent Application Laid-open Nos. 59-123670 (1984) and 59-138461 (1984) in order to achieve similar effects. The former discloses a structure in which a slit common to all the electrothermal transducers is used as ejection orifices of the electrothermal transducers, and the latter discloses a structure in which openings for absorbing pressure waves caused by thermal energy are formed corresponding to the ejection orifices. Thus, irrespective of the type of the recording head, the present invention can achieve recording positively and effectively.

The present invention can be also applied to a so-called full-line type recording head whose length equals the maximum length across a recording medium. Such a recording head may consists of a plurality of recording heads combined together, or one integrally arranged recording head.

In addition, the present invention can be applied to various serial type recording heads: a recording head fixed to the main assembly of a recording apparatus; a conveniently replaceable chip type recording head which, when loaded on the main assembly of a recording apparatus, is electrically connected to the main assembly, and is supplied with ink therefrom; and a cartridge type recording head integrally including an ink reservoir.

It is further preferable to add a recovery system, or a preliminary auxiliary system for a recording head as a constituent of the recording apparatus because they serve to make the effect of the present invention more reliable. As examples of the recovery system, are a capping means and a cleaning means for the recording head, and a pressure or suction means for the recording head. As examples of the preliminary auxiliary system, are a preliminary heating means utilizing electrothermal transducers or a combination of other heater elements and the electrothermal transducers, and a means for carrying out preliminary ejection of ink independently of the ejection for recording. These systems are effective for reliable recording.

The number and type of recording heads to be mounted on a recording apparatus can be also changed. For example, only one recording head corresponding to a single color ink, or a plurality of recording heads corresponding to a plurality of inks different in color or concentration can be used. In other words, the present invention can be effectively applied to an apparatus having at least one of the monochromatic, multi-color and full-color modes. Here, the monochromatic mode performs recording by using only one major color such as black. The multi-color mode carries out recording by using different color inks, and the full-color mode performs recording by color mixing.

Furthermore, although the above-described embodiments use liquid ink, inks that are liquid when the recording signal is applied can be used: for example, inks can be employed that solidify at a temperature lower than the room temperature and are softened or liquefied in the room temperature. This is because in the ink jet system, the ink is generally temperature adjusted in a range of 30° C.–70° C. so that the viscosity of the ink is maintained at such a value that the ink can be ejected reliably.

In addition, the present invention can be applied to such apparatus where the ink is liquefied just before the ejection by the thermal energy as follows so that the ink is expelled from the orifices in the liquid state, and then begins to solidify on hitting the recording medium, thereby preventing the ink evaporation: the ink is transformed from solid to liquid state by positively utilizing the thermal energy which would otherwise cause the temperature rise; or the ink, which is dry when left in air, is liquefied in response to the thermal energy of the recording signal. In such cases, the ink may be retained in recesses or through holes formed in a porous sheet as liquid or solid substances so that the ink faces the electrothermal transducers as described in Japanese Patent Application Laid-open Nos. 54-56847 (1979) or 60-71260 (1985). The present invention is most effective when it uses the film boiling phenomenon to expel the ink.

Furthermore, the ink jet recording apparatus of the present invention can be employed not only as an image output terminal of an information processing device such as a computer, but also as an output device of a copying machine including a reader, and as an output device of a facsimile apparatus having a transmission and receiving function.

As set forth above, according to the embodiments described above, when ejection data of a plurality of inks of different color indicate that the inks are ejected in duplicate to one pixel, in connection with generation of the ejection data of the printing ability improving liquid, AND data and OR data of data extracted from the printing data according to a predetermined rule, are taken as ejection data for the printing ability improving liquid, and ejection on the basis of the AND data is performed at different timing to ejection on the basis of the OR data. Therefore, even when the amount of the ink to be processed by the printing ability improving liquid is relative large for overlapping ejection of a plurality of inks, it becomes possible to adapt the amount of the processing liquid to be ejected by performing ejection on the basis of the OR data and ejection on the basis of the AND data.

As a result, since the printing ability enhancing liquid corresponding to the ejected ink amount can be ejected, satisfactory printing ability, such as sufficient water-resistance and the like, can be obtained.

The present invention has been described in detail with respect to preferred embodiments, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

What is claimed is:

1. An ink-jet printing apparatus performing printing by ejecting an ink and a printing ability improving liquid onto a printing medium with employing a plurality of ink ejecting portions for ejecting the ink and an ejecting portion for ejecting the printing ability improving liquid for making the ink insoluble or coagulated, said apparatus comprising:

signal supply means for supplying a signal by which the ink is elected from the plurality of ink ejection portions or the printing ability improving liquid is ejected from the ejecting portion for electing the printing ability improving liquid;

wherein said signal supply means supplies the signal so that ejection timings of the printing ability improving liquid on a basis of OR data and AND data of extracted data, which are extracted from ejection data for the plurality of ink ejecting portions in accordance with predetermined rules, are differentiated.

2. An ink-jet printing apparatus as claimed in claim 1, which comprises means for extracting said extracted data from said ejection data for the plurality of ink ejection portions in accordance with said predetermined rules, and means for performing OR and AND operations of said extracted data.

3. An ink-jet printing apparatus as claimed in claim 2, wherein the ejection timing of the printing ability improving liquid on the basis of the AND data is differentiated by taking said AND data as an ejection data of said printing liquid improving liquid for an adjacent pixel to aimed pixel.

4. An ink-jet printing apparatus as claim 2, wherein the ejection timing of the printing ability improving liquid on the basis of the AND data is differentiated by performing ejection in a scan different from a scan, in which ejection of the printing ability improving liquid on the basis of the OR data.

5. An ink-jet printing apparatus as claimed in claim 4, wherein said scan different from the scan is a reverse scan in reciprocal scan.

6. An ink-jet printing apparatus as claimed in claim 4, wherein said scan different from the scan is a scan performed after transportation of the printing medium.

7. An ink-jet printing apparatus as claimed in claim 1, which comprises means for performing a plurality of scanning operations for a plurality of divided regions defined by dividing a printing region to perform printing on the printing region by using each divided ink ejection openings which is defined by dividing, per predetermined number, a plurality of ink ejection openings of each of plurality of ink ejecting portions, and wherein ejection of the printing ability improving liquid on the basis of the AND data and the OR data is performed for different divided regions and at different scanning operation so as to differentiate the ejection timings.

8. An ink-jet printing apparatus as claimed in claim 1, wherein the plurality of ink ejecting portions and the ejecting portion for ejecting the printing ability improving liquid generate bubble in each of the ink and the printing ability improving liquid utilizing a thermal energy, respectively, and ejecting the ink and said printing ability improving liquid, respectively, by pressure of bubble.

9. An ink-jet printing method performing printing by ejecting an ink and a printing ability improving liquid onto a printing medium with employing a plurality of ink ejecting portions for ejecting the ink and an ejecting portion for ejecting the printing ability improving liquid for making the ink insoluble or coagulated, said method comprising the step of:

supplying a signal by which the ink is elected from the plurality of ink election portions or the printing ability improving liquid is ejected from the ejecting portion for ejecting the printing ability improving liquid;

wherein said step for supplying the signal supplies the signal so that ejection timings of the printing ability improving liquid on a basis of OR data and AND data of extracted data, which are extracted from ejection data for the plurality of ink ejecting portions in accordance with predetermined rules, are differentiated.

10. An ink-jet printing method as claimed in claim 9, which comprises a step for extracting said extracted data from said ejection data for the plurality of ink ejection portions in accordance with said predetermined rules, and step for performing OR and AND operation of said extracted data.

11. An ink-jet printing method as claimed in claim 9, wherein the plurality of ink ejecting portions and the ejecting portion for ejecting the printing ability improving liquid generate bubble in each of the ink and the printing ability improving liquid utilizing a thermal energy, respectively, and ejecting the ink and said printing ability improving liquid, respectively, by pressure of bubble.

12. A method of generating an ejection data for an ink-jet printing apparatus performing printing by ejecting an ink and a printing ability improving liquid onto a printing medium with employing a plurality of ink ejecting portions for ejecting the ink and an ejecting portion for ejecting the printing ability improving liquid for making the ink insoluble or coagulated, said method comprising the steps of:

generating OR data and AND data of extracted data which are extracted from ejection data for the plurality of ink ejecting portions in accordance with predetermined rules; and deriving an ejection data of the printing ability improving liquid on a basis of the OR data and the AND data generated.

13. A method as claimed in claim 12, wherein one of said predetermined rules is a rule that the extracted data is made the same as the ejection data for the ink ejection portion.

14. A method as claimed in claim 12, wherein one of said predetermined rules is a rule that the extracted data is extracted from the ejection data of a raster for the ink ejection portion, said extraction being performed every other dot in a sequential order from an edge of the raster.

15. A method as claimed in claim 12, wherein the ejection data of the printing ability improving liquid is generated on a basis of the OR data and the AND data so that said ejection data of the printing ability improving liquid is generated as OR data of the OR data of the extracted data which is made the same as the ejection data for the ink ejecting portion and the extracted data which is extracted from the ejection data of a raster for the ink ejecting portion, said extraction being performed every other dot in a sequential order from an edge of the raster, and the data obtained by shifting, by one dot, the AND data of the extracted data which is made the same as the ejection data for the ink ejection portion and the extracted data which is extracted from the ejection data of the raster for the ink ejection portion, said extraction being performed every other dot in a sequential order from the edge of the raster.

* * * * *

UNITED STATES PATENT AND TRADEMARK OFFICE

CERTIFICATE OF CORRECTION

PATENT NO. : 6,099,116

DATED : August 8, 2000

INVENTOR(S) : FUJITA ET AL.

It is certified that error appears in the above-identified patent and that said Letters Patent is hereby corrected as shown below:

In the Drawings:

Sheet 5, Figure 5, "EFFDING" should read --FEEDING--.

Sheet 9, Figure 9, "915" (lowermost occurrence) should read --915A--.

Sheet 13, Figure 13A, "EFFDING" should read --FEEDING--.

COLUMN 2:

Line 49, "avoiding" should read --avoid--.

COLUMN 3:

Line 12, "circumstance," should read --circumstances,--.

COLUMN 4:

Lines 2 and 3, "may be not" should read --may not be--.

COLUMN 8:

Line 22, "cyan magenta" should read --cyan, magenta--.

COLUMN 14:

Line 1, "fuloropore filter" should read --Fluoropore filter--.

Line 32, "Fuloroporefilter," should read --Fluoropore filter--.

Line 43, "M1" should be deleted.

Before Line 45, --M1-- should be inserted (after line demarcating end of preceding table).

UNITED STATES PATENT AND TRADEMARK OFFICE

CERTIFICATE OF CORRECTION

PATENT NO. : 6,099,116

DATED : August 8, 2000

INVENTOR(S) : FUJITA ET AL.

It is certified that error appears in the above-identified patent and that said Letters Patent is hereby corrected as shown below:

COLUMN 15:
Line 49, "vp 5magenta" should read --magenta--.
Line 59, "neutralizing agent" should read --neutralizing agent:--.

COLUMN 19:
Line 66, "as claim 2," should read --as claimed in claim 2,--.

COLUMN 20:
Line 34, "elected" should read --ejected--.
Line 35, "election" should read --ejection--.

Signed and Sealed this

Seventeenth Day of April, 2001

*Attest:*

Nicholas P. Godici

NICHOLAS P. GODICI

*Attesting Officer*

*Acting Director of the United States Patent and Trademark Office*